US008979244B2

(12) United States Patent
Kritchman et al.

(10) Patent No.: US 8,979,244 B2
(45) Date of Patent: Mar. 17, 2015

(54) SHAPED WIPER FOR INKJET CLEANING

(71) Applicant: Xjet Ltd., Rehovot (IL)

(72) Inventors: Eli Kritchman, Tel Aviv (IL); Hanan Gothait, Rehovot (IL); Timofey Shmal, Holon (IL); Sharon Fima, Kibbutz Ein Dor (IL)

(73) Assignee: XJET Ltd., Rehovot (IL)

( * ) Notice: Subject to any disclaimer, the term of this patent is extended or adjusted under 35 U.S.C. 154(b) by 0 days.

(21) Appl. No.: 14/070,540

(22) Filed: Nov. 3, 2013

(65) Prior Publication Data

US 2014/0055525 A1 Feb. 27, 2014

Related U.S. Application Data

(62) Division of application No. 13/824,463, filed as application No. PCT/IB2011/054645 on Oct. 18, 2011.

(60) Provisional application No. 61/393,950, filed on Oct. 18, 2010.

(51) Int. Cl.
*B41J 2/165* (2006.01)

(52) U.S. Cl.
CPC ..... *B41J 2/16535* (2013.01); *B41J 2/16538* (2013.01); *B41J 2/165* (2013.01)
USPC ..... 347/33

(58) Field of Classification Search
CPC .... B41J 2/165; B41J 2/16535; B41J 2/16538; B41J 2/16552
USPC ..... 347/33
See application file for complete search history.

(56) References Cited

U.S. PATENT DOCUMENTS

| | | | | |
|---|---|---|---|---|
| 7,798,598 | B2 * | 9/2010 | Horie | 347/33 |
| 2008/0047885 | A1 | 2/2008 | Shiekelmacher | |
| 2008/0286021 | A1 * | 11/2008 | Asami | 399/351 |

FOREIGN PATENT DOCUMENTS

| | | |
|---|---|---|
| DE | 19944107 | 4/2001 |
| GB | 1485989 | 9/1977 |
| WO | 2011058556 | 5/2011 |

* cited by examiner

*Primary Examiner* — Alessandro Amari
*Assistant Examiner* — Michael Konczal
(74) *Attorney, Agent, or Firm* — Mark M. Friedman

(57) ABSTRACT

Inkjet head cleaning and storage includes cleaning an orifice plate by inserting a tip of a shaped wiper into a slit of a printing mask, such that one or more shoulders of a handling end of the shaped wiper are in contact with respectively one or more edges of the slit. The shoulders of the shaped wiper facilitate the tip applying a predetermined pressure to an orifice surface during wiping. Preventing sediment buildup during extended periods of non-printing includes placing at least the orifice plate of the printing head in a protecting liquid that avoids evaporation of the volatile liquid from the nozzles. An innovative "night plate" can be used to seal the slit of a printing mask and ink purged from the printing head used to fill a gap between the printing head and the mask, thereby covering at least the orifice plate with the purged ink.

19 Claims, 13 Drawing Sheets

SHAPED WIPER FOR INKJET CLEANING

CROSS-REFERENCE TO RELATED APPLICATIONS

This application claims the benefit of provisional patent application (PPA) Ser. No. 61/393,950 filed Oct. 18, 2010 by the present inventors, which is incorporated by reference.

FIELD OF THE INVENTION

The present embodiment generally relates to the field of printing, and in particular, it concerns a printing system for inkjet head maintenance by cleaning an orifice plate and preventing sediment buildup.

BACKGROUND OF THE INVENTION

It is known in the field of printing that inkjet printing heads, often simply called heads, require periodic cleaning of printing nozzles, to remove buildup (solid sediments) on the nozzles, remove air bubbles, and maintain printing quality. Cleaning the printing head is a significant part of the inkjet printing process, for example in some industrial settings the printing head is cleaned as often a every two minutes. The frequency of cleaning depends on the specific application for which the printing head is being used. Simply stated, inkjet printers operate by expelling a small volume of ink from a plurality of nozzles through corresponding small orifices in an orifice plate held in proximity to a paper or other medium, also known as a substrate, upon which printing or marks are to be placed. The orifices are arranged in a fashion in the orifice plate such that the expulsion of droplets of ink from a selected number of nozzles relative to a particular position of the medium results in the production of a portion of a desired character or image. Controlled repositioning of the medium relative to the nozzles, followed by another expulsion of ink droplets, results in the creation of more segments of the desired character or image.

An orifice plate, as is generally known in the industry, is located on the printing side of the printing head, providing access for the nozzles to print, while also providing protection for the printing head, among other features. The outside or downward surface of the orifice plate is referred to as an orifice surface. Note that typically nozzles interface with the orifice surface via "cells", with the jetting-end of each nozzle having a cell that surrounds the nozzle. The opening of the cell to the orifice surface provides an orifice. Jetted ink from each nozzle exits the orifice for printing.

During periodic cleaning and after purging, preferably the orifice surface is cleaned, known as wiping, to remove buildup, purged liquid, and enable proper jetting of the printing liquid from the nozzles (via the orifices). In order to preserve the smoothness and non-wetting (anti-wetting) characteristic of the orifice surface, care must be taken in performing wiping.

One conventional technique for wiping without contact to the orifice plate is vacuum wiping, where a vacuum head is moved across the orifice plate. The vacuum head does not contact the orifice plate but is sufficiently close to allow the vacuum, also known as suction, to remove the purged liquid from the orifice plate. As the vacuum head does not contact the orifice plate, there is suction from all sides of the vacuum head (not just from the direction of the orifice plate) resulting in low cleaning efficiency of the orifice plate. Disadvantages to conventional vacuum wiping include cost, printing speed, reliability, and quality of wiping.

Another challenge of wiping is when a mask, also called a cooling mask, is used with the printing head. A mask surrounds the printing head, providing protection for the printing head and functioning as an insulating shield, minimizing heat exchange between the printing head and a substrate. Protection includes protecting the printing head from excessive heat (or cold) from the medium (substrate) and from physical collision with objects on a printing tray. An example is printing metallization on a photovoltaic wafer, wherein the wafer is warmed before printing to 220 degrees Celsius. At least a portion of the mask is between the nozzles and the medium. The mask includes one or more slits corresponding to one or more nozzles. The slits are positioned and sized to allow jetted ink from the nozzles to pass through the mask (via the corresponding slit) to the printing medium. Typically and preferably, a row of nozzles on the orifice plate is offset only a small amount from the edge of the slit. Nozzles are offset only a small amount so the nozzles are located close to the edge of the slit in order to facilitate at least two goals. A first goal is to shield the nozzles from fumes emerging from the substrate. In this context of shielding, a small amount is in comparison to the size of the slit, with a typical offset being approximately 10% or less of the width of the slit. For example, when the slit width is 1 mm, the offset may be 100 μm or less. A second goal is to facilitate easier ink sucking under the mask during purge. In the context of easier ink sucking, a small amount is in comparison with a size of an orifice diameter, the size of a gap between the mask floor and orifice plate, the quality of non-wetting characteristics of the orifice, and the surface tension of the dispensed liquid. For example, with an orifice diameter of 20 μm, a gap of 150 μm, reasonable wetting characteristics, and reasonable ink surface tension, an offset of 150 μm or less has shown to be effective.

The use of a mask further reduces the efficiency of using vacuum cleaning to wipe the orifice plate. Refer to WIPO application IB11/051934 filed on May 2, 2011, which claims priority from U.S. provisional application 61/330,351 for additional information on masks.

When ink used for printing is a volatile liquid, the ink at a tip of a nozzle may lose a portion of the ink, with the remaining ingredients of the ink forming a semi-solid skin at the nozzle tip. The semi-solid skin, or buildup of solid sediments, can interfere with the jetting of ink from the nozzles, reducing the quality or even disabling jetting of ink from one or more nozzles. As the nozzle tips are aligned with orifices in an orifice plate, sediment buildup can also be on the orifices and/or orifice plate. In the context of this document, buildup on nozzles, orifices, and/or an orifice plate all present the same problem of sediment buildup. Because sediment can gradually build even during continuos printing wiping the printing head/orifice plate should be done on a timely basis or in respect to a number of printing passes. Sediment buildup is a particular problem when printing pauses, or stops, for an extended period. During an extended period of non-printing, the liquid portion of ink that remains on, or in, the nozzles can evaporate, leaving behind sediment. When desiring to resume printing, time must first be spent wiping the printing head to clean the sediment from the nozzles.

There is therefore a need for a system for cleaning an orifice plate, with increased efficiency over conventional techniques, and preventing sediment buildup.

SUMMARY

According to the teachings of the present embodiment there is provided a method of printing including the steps of:

inserting a tip of a shaped wiper into a slit of a mask, such that one or more shoulders of a handling end of the shaped wiper are in contact with respectively one or more edges of the slit, and the tip applies a pre-determined pressure to an orifice surface; and moving the shaped wiper relative to the orifice surface such that the tip wipes the orifice surface.

In an optional embodiment the step of inserting a tip includes inserting the tip via a wider section on a side of the slit, the wider section configured to accept the tip of the shaped wiper and guide the tip into the slit. In another optional embodiment, the step of inserting a tip includes inserting the tip via a side of the slit. In another optional embodiment, the step of inserting a tip includes inserting the tip from a bottom of the slit. In another optional embodiment, the step of moving the shaped wiper includes moving the shaped wiper along the slit while maintaining contact between the one or more shoulders ad respectively the one or more edges of the slit. In another optional embodiment, the step of moving the shaped wiper includes moving the shaped wiper along the slit while maintaining contact between one or sides of the tip and respectively one of more edges of the slit.

In an optional embodiment, during non-wiping periods, at least the tip of the shaped wiper is stored in a fluid selected from the group consisting of cleaning liquid, and printing liquid.

In another optional embodiment, the tip is made of an open-cell foam.

In an optional embodiment, the tip has a tip-width and a tip-height; and the handling end has a side with a side-width greater than the tip-width, wherein the tip is positioned on the side so as to configure the handling end with the one or more shoulders on the side, the shoulder-width of the one or more shoulders being the difference between the side-width and the tip-width. In another optional embodiment, the tip is positioned on the side so as to configure the handling end with two shoulders, each of the two shoulders on opposite sides of the tip. In another optional embodiment, the each of the two shoulders is of substantially the same width. In another optional embodiment, the slit has a slit-width substantially equal to a tip-width of the tip. In another optional embodiment, the orifice surface has one or more orifices having an orifice-diameter, and a tip-width of the tip is at least as wide as the orifice-diameter, thereby allowing the one or more orifices to be wiped by one pass of the tip of the shaped wiper. In another optional embodiment, the pre-determined pressure is selected from an acceptable pro-determined range of pressures. In another optional embodiment, the orifice surface is of an inkjet printing head.

According to the teachings of the present embodiment there is provided a printing system including: a shaped wiper including: a tip having a tip-width and a tip-height; and a handling end having a side with a side-width greater than the tip-width; wherein the tip is positioned on the side so as to configure the handling end with one or more shoulders on the side, the shoulder-width of the one or more shoulders being the difference between the side-width and the tip-width; and the tip-height configured such that when the one or more shoulders are pressed against one or more edges of a slit with a given shield-depth, the tip-height is substantially equal to the shield depth, wherein the shield-depth is a distance between the one or more edges of the slit and an orifice surface.

In an optional embodiment, the tip is positioned on the side so as to configure the handling end with two shoulders, each of the two shoulders on opposite sides of the tip. In another optional embodiment, each of the two shoulders is of substantially the same width. In another optional embodiment, when the one or more shoulders are pressed against one or more edges of a slit with a given shield-depth, the tip applies a pre-determined pressure to the orifice surface. In another optional embodiment, the pro-determined pressure is selected from an acceptable pro-determined range of pressures.

In another optional embodiment, the printing system includes a printing mask including a slit, the slit having a slit-width substantially equal to the tip-width. In another optional embodiment, the slit includes one or more wider sections on at least one corresponding side of the slit, the wider sections configured to accept the tip of the shaped wiper and guide the tip into the slit. In another optional embodiment, the slit-width is between 0.4 millimeter (mm) and 2 mm. In another optional embodiment, the tip-width is equal to or greater than the slit-width, and equal to or less than the slit-width plus ten percent of the slit width [(tip-width=slit width+(0 to 10%)]. In another optional embodiment, the shield-depth from the orifice surface to a bottom of the mask is between 0.4 mm and 2 mm (shield-depth=0.4 to 2 mm) and the tip-height from the one or more shoulders to a distal end of the tip is the shield-depth plus 5% to 30% of the first height (tip-height=shield-depth+5% to 30%).

In an optional embodiment, the orifice surface has one or more orifices having an orifice-diameter, and the tip-width is at least as wide as the orifice-diameter, thereby allowing the one or more orifices to be wiped by one pass of the tip of the shaped wiper.

In an optional embodiment, the tip is made of an open-cell foam. In another optional embodiment, the tip is made of polyolefin.

In another optional embodiment, the orifice surface is of an inkjet printing head.

According to the teachings of the present embodiment there is provided a method of storing a printing head during periods of non-printing including the steps of positioning an ink retainer relative to the printing head so that printing ink is in contact with substantially all of an orifice surface, the printing ink at least partially filling at least a portion of the ink retainer, and filling, at least partially, the ink retainer with the printing ink.

In an optional embodiment, method includes the step of positioning the ink retainer relative to the printing head so that during printing, ink can be jetted from the orifice surface to a substrate.

In an optional embodiment, the ink retainer includes an ink bath configured so that when at least a portion of the bath surrounds the orifice surface, and the portion is at least partially filled with printing ink, the printing ink is in contact with substantially all of the orifice surface.

In another optional embodiment, the bath is at least partially filled with the printing ink purged from the printing head. In another optional embodiment, the ink retainer includes an open-cell foam, the open cell foam is at least partially filled with the printing ink, and then the filled open-cell foam is positioned in contact with the orifice surface. In another optional embodiment, the ink retainer includes an open-cell foam, the open-cell foam is positioned in contact with the orifice surface, and then the open cell foam is at least partially filled with the printing. In another optional embodiment, the printing ink is purged from the printing head to at least partially fill the open-cell foam.

In an optional embodiment, the ink retainer is filled repeatedly with the printing ink. In another optional embodiment, the ink retainer is filled repeatedly by purging ink from the printing head. In another optional embodiment, at least a portion of the printing ink is removed from the ink retainer, and at least a portion of the removed ink is made available for filling the ink retainer. In another optional embodiment, at least a portion of the printing ink is removed from the ink retainer, and new ink is made available for filling the ink retainer.

According to the teachings of the present embodiment there is provided a printing system including a printing head with an orifice surf ee, the system including an ink retainer configured with at least a portion of the ink retainer at least partially filled with printing ink; and a positioning mechanism operable to configure the ink retainer relative to the printing head such that: in a first state during periods of non-printing wherein the ink retainer is positioned relative to the printing head such that the printing ink is in contact with substantially all of the orifice surface; and in a second state during printing such that ink can be jetted from the orifice surface to a substrate.

In an optional embodiment, the ink retainer is at least partially filled with the printing ink purged from the printing head.

In another optional embodiment, the ink retainer includes an open-cell foam and the open cell foam is at least partially filled with the printing ink prior to the open-cell foam contacting the orifice surface. In another optional embodiment, the ink retainer includes an open-cell foam and the open cell foam is at least partially filled with the printing ink after the open-cell foam is in contact with the orifice surface. In mother optional embodiment, the open cell foam is at least partially filled with the printing ink purged from the printing head.

In an optional embodiment, the ink retainer includes a bath configured so that when at least a portion of the bath surrounds the orifice surface, and the portion is at least partially filled with printing ink, the printing ink is in contact with substantially all of the orifice surface. In another optional embodiment, the bath is at least partially filled with the printing ink prior to the bath surrounding the orifice surface. In another optional embodiment, the bath is at least partially filled with the printing ink after the bath surrounds the orifice surface. In another optional embodiment, the bath is at least partially filled with the printing ink purged from the printing head.

In an optional embodiment, the ink retainer is filled repeatedly with the printing ink. In another optional embodiment, the ink retainer is filled repeatedly by purging ink from the printing head. In another optional embodiment at least a portion of the printing ink is removed from the ink retainer, and at least a portion of the removed ink is made available for filling the ink retainer.

According to the teachings of the present embodiment there is provided a method for printing including the steps of providing an attachment mechanism, the attachment mechanism configured to position a sealing element in contact with a slit of a mask, the sealing element at least in contact with substantially all of the slit, the contact being on a bottom side of the mask and the contact having a sealing pressure sufficient for preventing a fluid on a top-side of the mask from going through the slit to the bottom-side of the mask, the top-side being opposite the bottom-side, so as to configure the sealing element and the attachment mechanism as a nigh plate; and positioning the sealing element in contact with the slit, corresponding to an attached configuration of the night plate.

In an optional embodiment, the sealing element is non-porous. In another optional embodiment, the sealing element is a closed-cell foam. In another optional embodiment, the sealing element is HT-800.

In an optional embodiment, the attachment mechanism includes one or more stoppers configured as part of the night plate to prevent the sealing element from contacting the slit with excess pressure when the night plate is in the attached configuration.

In an optional embodiment, the sealing pressure is selected from an acceptable pre-determined range of pressures. In another optional embodiment, the step of positioning the sealing element in contact with the slit includes: connecting the attachment mechanism to the mask.

In an optional embodiment, the step of positioning the sealing element in contact with the slit includes: connecting the attachment mechanism to an inkjet printing head, wherein in a detached configuration the night plate is configured to allow jetting of ink from the inkjet printing head through the slit.

In another optional embodiment, the nightplate is in the attached configuration and a gap between the printing head and the top-side of the mask is filled with a sufficient amount of protecting fluid to cover at least an orifice surface of the printing head with the ink.

In another optional embodiment, the protecting fluid is ink purged from the printing head. In another optional embodiment, after filling the gap with ink, the ink is removed from the gap. In another optional embodiment, the ink is circulated through the head during at least part of the time when the sealing element seals the mask slit. In another optional embodiment, the ink is first removed from the top-side of the mask and then ink is purged into the mask. In another optional embodiment, the ink is removed from the gap via a vacuum system. In another optional embodiment, after the ink is removed from the gap, the night plate is moved to the detached configuration.

According to the teachings of the present embodiment there is provided a printing system, including: a printing head and a printing mask having a slit, the printing mask configured relative to the printing head such that during printing ink can be jetted from the printing head, through the slit, to a substrate; sealing element; and an attachment mechanism, wherein in a first state during periods of non-printing the attachment mechanism is positioned relative to the printing head such that the sealing element is in contact with the slit of the printing mask, the scaling element at least in contact with substantially all of the slit, the contact being on a bottom side of the mask and the contact having a sealing pressure sufficient for preventing a fluid on a top-side of the mask from going through the slit to the bottom-side of the mask, the top-side being opposite the bottom-side, so as to configure the sealing element and the attachment mechanism as a night plate; and in a second state during printing the attachment mechanism is configured to position the sealing element such that ink can be jetted from the printing head to a substrate.

In an optional embodiment, the sealing element is non-porous. In another optional embodiment, the sealing element includes a non-penetrable top-side surface. In another optional embodiment, the sealing element is a closed-cell foam. In another optional embodiment, the sealing element is resilient and compressible. In another optional embodiment, the sealing element is HT-800 5 mm thick.

In an optional embodiment, the system further includes: one or more stoppers configured as part of the night plate to prevent the sealing element from contacting the slit with excess pressure when the sealing element is in contact with the slit. In another optional embodiment, the sealing pressure is selected from an acceptable pr-determined range of pressures.

In an optional embodiment, the system further includes: an inkjet printing head, wherein in a detached configuration the night plate is configured to allow jetting of ink from the inkjet printing head through the slit.

In an optional embodiment, the sealing element is in contact with the slit, corresponding to an attached configuration of the nightplate, and a gap between the printing head and the top-side of the mask is filled with a sufficient amount of protecting fluid to cover at least an orifice surface of the printing head with the ink. In another optional embodiment, the protecting fluid is ink purged from the printing head.

In another optional embodiment, the system includes: an ink removal system configured to remove the ink from the gap. In another optional embodiment, the ink removal system is a vacuum system.

In an optional embodiment, the attachment mechanism includes at least two springs, a first end of each of the springs mounted on opposite sides of the sealing element, and in the attached configuration a second and of each of the springs connected to the mask, the springs configured to facilitate the sealing element contacting substantially all of the slit with the sealing pressure. In another optional embodiment, the attachment mechanism includes: a rotatable clip mounted on a first portion of the attachment mechanism; and at least one attachment sub-mechanism mounted on a second portion of the attachment mechanism, the first portion and the second portion on opposite sides of the sealing element, wherein in the attached configuration the rotatable clip and the at least one attachment sub-mechanism are connected to the mask, in the detached configuration the at least one attachment sub-mechanism is disconnected from the mask, and wherein the attachment sub-mechanism is configured to facilitate the sealing element contacting substantially all of the slit with the sealing pressure.

In another optional embodiment, the at least one attachment sub-mechanism includes a spring. In another optional embodiment, the at least one attachment sub-mechanism includes a latch. In another optional embodiment, in the detached configuration the rotatable clip is connected to the mask. In another optional embodiment, in the detached configuration the rotatable clip is disconnected from the mask.

According to the teachings of the present embodiment there is provided a printing system including: an inkjet printing head including a mask with a slit; a sealing element; and an attachment mechanism, the attachment mechanism configured to position the sealing element in contact with the slit of the mask, the sealing element at least in contact with substantially all of the slit, the contact being on a bottom side of the mask and the contact having a sealing pressure sufficient for preventing a fluid on a top-side of the mask from going through the slit to the bottom-side of the mask, the top-side being opposite the bottom-side, so as to configure the sealing element and the attachment mechanism as a night plate.

BRIEF DESCRIPTION OF FIGURES

The embodiment is herein described, by way of example only, with reference to the accompanying drawings, wherein.

DETAILED DESCRIPTION

The principles and operation of the system according to a present embodiment may be better understood with reference to the drawings and the accompanying description. A present invention is a printing system for inkjet head maintenance by cleaning an orifice plate and preventing sediment buildup. The system facilitates cleaning a printing head, and in particular cleaning an orifice plate, with increased efficiency over conventional techniques, and preventing sediment buildup during non-printing times.

An innovative method for cleaning an orifice plate includes inserting a tip of a shaped wiper into a slit of a printing mask, such that one or more shoulders of a handling end of the shaped wiper are in contact with respectively one or more edges of the slit. The shoulders of the shaped wiper facilitate the tip applying a pre-determined pressure to an orifice surface. When the shaped wiper is moved relative to the orifice surface, the tip wipes the orifice surface.

An innovative method for preventing sediment buildup during extended periods of non-printing includes placing at least the orifice plate of the printing head in a protecting liquid that avoids evaporation of the volatile liquid from the nozzles, thereby preventing sediment buildup on the printing head. In a case where a printing mask is being used, an innovative "night plate" can be used to seal the slit. After sufficiently sealing the slit using the night plate, ink is purged from the printing head to fill a gap between the printing head and the mask, thereby covering at least the orifice plate with the purged ink. The purged ink acts as a protecting fluid, preventing evaporation of ink from the orifice surface, thereby preventing sediment buildup on the printing head.

Although this implementation is described with regard to an inkjet printing head, the described system and method is generally applicable to liquid-ejection nozzles of a liquid-ejection mechanism, such as nozzle dispensers. In the context of this document, the terms "printing liquid" and "ink" refer in general to a material used for printing, and includes, but is not limited to homogeneous and non-homogenous material, for example a carrier liquid containing metal particles to be deposited via the printing process.

Figure 1A:
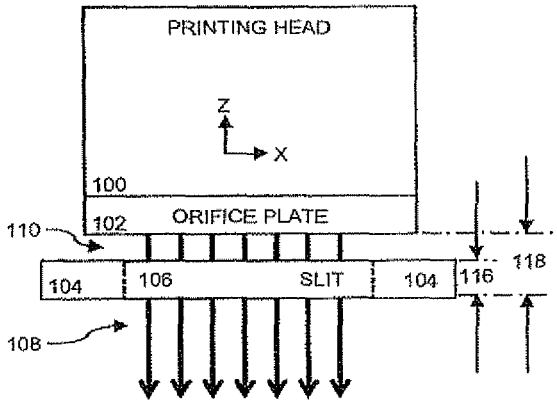
PRIOR ART FIGURE 1A
FIG. 1A, a first view of a printing system including a printing mask.
Figure 1B:
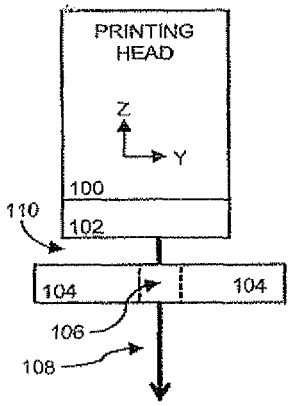
PRIOR ART FIGURE 1B
FIG. 1B, a second view of a printing system including a printing mask.
Figure 1C:
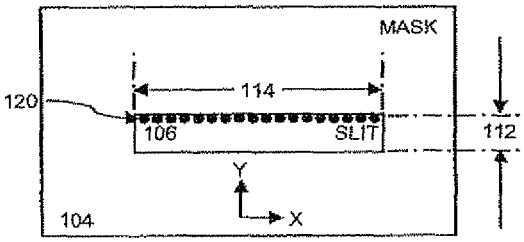
PRIOR ART FIGURE 1C
FIG. 1C, a third view of a printing system including a printing mask.

Referring now to the drawings, FIG. 1A is a first view, FIG. 1B is a second view, and FIG. 1C is a third view of a printing system including a printing mask. For convenience FIG. 1A, FIG. 1B, and FIG. 1C are arbitrarily respectively referred to as a front view, side view, and bottom view. Note that figures are not drawn to scale. An inkjet printing head 100 typically includes an orifice plate 102. Ink is printed from a multitude of nozzles in the printing head. The ink is printed in the direction of arrows 108 to a printing substrate (not shown). Note that this system can be used for one or more nozzles, although normal usage in this field is with a multitude of nozzles. For convenience, the direction of the ink from the printing head to the printing substrate shown by arrows 108 is referred to as downward. Typically, the downward surface of the orifice plate 102 provides an orifice surface (not shown). In implementations where an orifice plate is not being used, the surface of the printing head containing the nozzles provides an orifice surface.

FIG. 1A shows a plurality of arrows 108 indicating the printing direction of ink from a row of nozzles, while the side view of FIG. 1B shows only one arrow as from a side view only the single row is visible. The positioning of a printing mask 104, also referred to in the context of this document as a mask, aligned with orifice plate 162 creates a gap 110 between the orifice plate and the printing mask. The nozzles of the printing head are aligned with a slit 106 in the printing mask 104 to facilitate printing. The slit 106 is preferably as narrow as possible to allow maximum protection of the printing head. Height 116, also referred to as depth, is generally substantially the same as the thickness of the printing mask. Distance 118, referred to in the context of this document as "shield-depth" 118, is the distance between the surface of orifice plate 102 and the bottom of mask 104.

For convenience and clarity in referring to the printing system, the direction typically referred to as the "up/down" direction is shown by a Z-axis, side-to-side as an X-axis, and front/back as a Y-axis.

FIG. 1C is a third view of a printing system including a printing mask, from the direction in which the ink is printed. For reference, the slit 106 has slit-width 112 and slit-length 114. The printing direction is known in the printing industry as a scan direction. A direction parallel to the scan direction is known as in-scan, and a direction perpendicular to the scan direction is known as cross-scan. In an application of printing thin lines in the direction of scan (in-scan), the printing heads have a single row of nozzles per slit, as shown by row of nozzles 120. Both the row of nozzles 120 and the slit 106 are aligned in-scan. The scan direction is the direction in which the printing head moves relative to the substrate on which printing is being done, shown as the X-axis. For clarity in the context of this document, the "sides" of a slit 106 are defined as the furthest left and right (on the X-axis) portions of the slit, and generally run in the front/back (Y-axis direction). The "edges" of a slit 106 are defined as the furthest front and back (on the Y-axis) portions of the slit, and generally run in the left/right (X-axis direction).

Figure 1D:
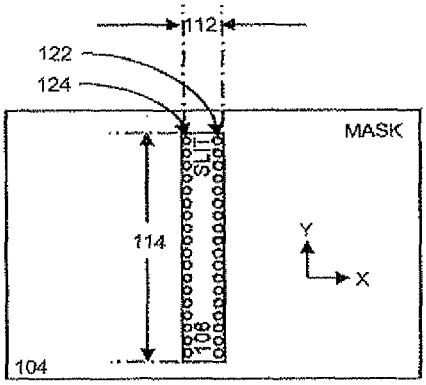
PRIOR ART FIGURE 1D
FIG. 1D, a diagram of a double-row head.

Referring to FIG. 1D, a diagram of a double-row head is shown. Printing heads can include more than a single row of nozzles per head or per slit, with corresponding differences in the orifice plate, mask and other printing system components, from those typical of single-row heads, as will be obvious to one ordinarily skilled in the art. Without limiting the applicability of the present invention, we refer now to a double-row head in a cross-scan direction. A multitude of nozzles in the printing head is shown as a first-row of nozzles 122, and a second-row of nozzles 124, with the designators first-row and second-row being arbitrary designators for clarity in this description. In the double-row head of the current example, the rows of nozzles and corresponding slit are oriented cross-scan. For clarity in this document the description generally refers to a single row of nozzles in-scan (X-axis). Based on this description, one skilled in the art will be able to apply the invention to a variety of print heads including, but not limited to, single-row, double-row, and multiple row heads.

A printing mask 104 it aligned with an orifice plate 102. In the context of this document, a mask refers to a plate that partially covers orifice plate 102 and has an opening to facilitate printing from nozzles to a print area. An orifice plate 102 is generally used during the printing process to facilitate printing from the nozzles and can provide protection for the printing head 100 and nozzles. In normal operation slit 106 in printing mask 104 is sufficiently wide and aligned sufficiently accurately with the printing nozzles to facilitate printing. In the case of an inkjet printing head 100, printing includes jetting droplets of ink from nozzles (not shown). Jetting includes applying an appropriate pressure for an appropriate duration to the printing head, causing the printing head to discharge droplets of a printing liquid (ink) from the nozzles, through an opening (not shown) in orifice plate 102, across gap 110, through slit 106 in printing mask 104, and onto a printing substrate (not shown). In one non-limiting example, a 20 um (micrometer) wide nozzle prints through a slit having a slit-width 112 between 100 and 300 um.

Similarly, mask 104 needs to be sufficiently thick (dimension 116) to provide the necessary mechanical strength and beat conduction, and preferably as thin as possible so the nozzles can be as close as possible to the printing surface.

First Embodiment

FIGS. 1 to 10

Figures 2A, 2B:
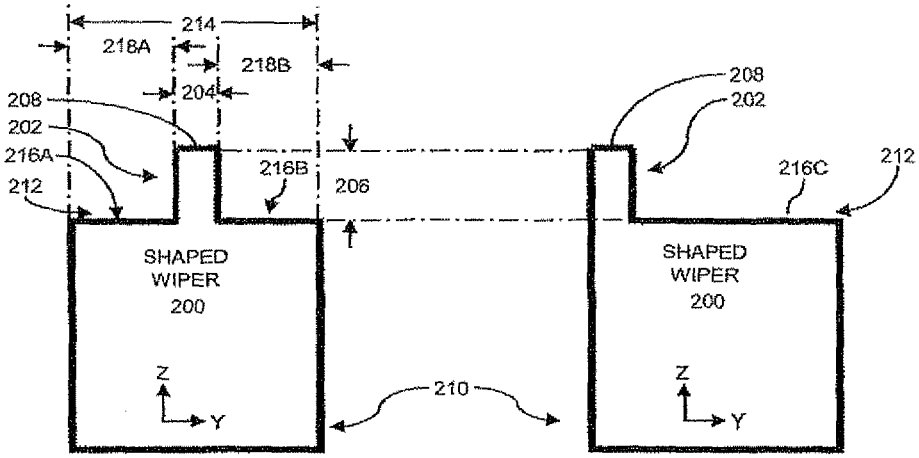
FIG. 2A, a sketch of a side view of a shaped wiper.
FIG. 2B, a sketch of a side view of a shaped wiper with one shoulder.
Figures 2C, 3:
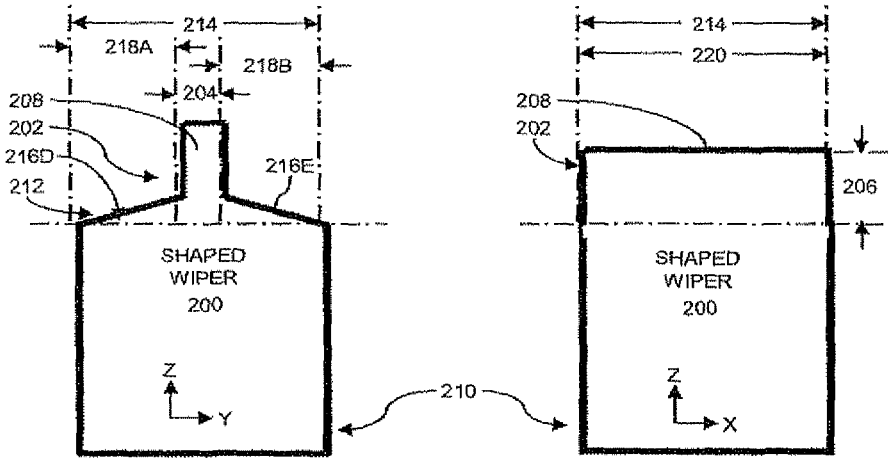
FIG. 2C, a sketch of a side view of a shaped wiper with angled shoulders.
FIG. 3, a sketch of a front view of a shaped wiper.

Referring to FIG. 2A, a sketch of a side view of a shaped wiper, a printing system includes a shaped wiper 200 that includes a tip 202 having a tip-width 204 and a tip-height 206. Shaped wiper 200 also includes a handling end 210 having a side 212 with a side-width 214 greater than the tip-width 204. The tip 202 is positioned on the side 212 so as to configure the handling end with one or more shoulders 216 (in FIG. 2A shown as 216A and 216B) on side 212. The shoulder-width 218 of the one or more shoulders is the difference between the side-width and the tip-width (shown in FIG. 2A as the sum of 218A and 218B). The tip-width 204 is configured sufficiently narrow to allow the tip 202 to penetrate the slit, and sufficiently wide to assure that the full width of the orifice surface facing the mask, is wiped. The tip-height 206 is configured such that during wiping the tip applies a pre-determined pressure to an orifice surface. The portion of tip 202 that contacts the orifice surface and performs removal of buildup during wiping is a distal end 208 of tip 202, from the perspective of the handling end, as will be obvious to one skilled in the art. Note that FIGS. 2A-2C are side views, so tip-width 204 is in the front/back direction of the Y-axis, and tip-height 206 is in the up/down direction of the Z-axis.

The tip 202 is positioned on side 212 so as to configure the handling end 210 with two shoulders 216A and 216B, each of the two shoulders on opposite sides of tip 202. The shoulder-width 218A of shoulder 216A is substantially equal to the shoulder-width 218B of shoulder 218B.

The shape of the handling end can vary depending on the application, including but not limited to cubes, rectangular-cubes, and cylindrical. In the case where the handling end is a cylinder with the axis parallel to the direction of the height of the tip, the side of the handling end is the top (or bottom) of the cylinder, and the side-width the diameter of the cylinder.

Referring to FIG. 2B, a sketch of a side view of a shaped wiper with one shoulder, a printing system includes a shaped wiper 200 where tip 202 is positioned on side 212 so as to configure the handling end 210 with one shoulder 216C.

Referring to FIG. 2C, a sketch of a side view of a shaped wiper with angled shoulders, a printing system includes a shaped wiper 200 where shoulders 216D and 216E are not perpendicular to tip 202. Depending on the application, angled shoulders may be desirable due to compression of the material of the shaped wiper during operation, physical characteristics of the printing system, in particular of a mask and/or slit, or due to manufacturing processes of the shaped wipers. In a case where a shoulder is not perpendicular to the tip, the shoulder width is measured in the direction of the Y-axis, perpendicular to the Z-axis direction of the tip-height. Note that the reference lines for measuring the height of the tip are somewhat arbitrary and other locations of the shaped wiper can be used for measuring purposes, depending on the specific application for which the shaped wiper is being used, and the specific properties of the material from which the shaped wiper is constructed.

Referring to FIG. 3, a sketch of a front view of a shaped wiper, the tip-length 220 of tip 202 is substantially equal to the side-width 214. Note that FIG. 3 is a front view, so tip-length 2201 is in the left/right direction of the X-axis, and tip-height 206 is in the up/down direction of the Z-axis. The tip-length 220 an be of arbitrary size, with a minimum and maximum size determined by the realities of the size of the slit and shaped wiper. Preferably, the tip-length 220 is substantially equal to the side-width 214. Depending on the specific application for which shaped wiper 200 is being used, the tip-length 220 can be shorter than, substantially equal to, or longer than the side-width 214.

Figures 4A, 4B:
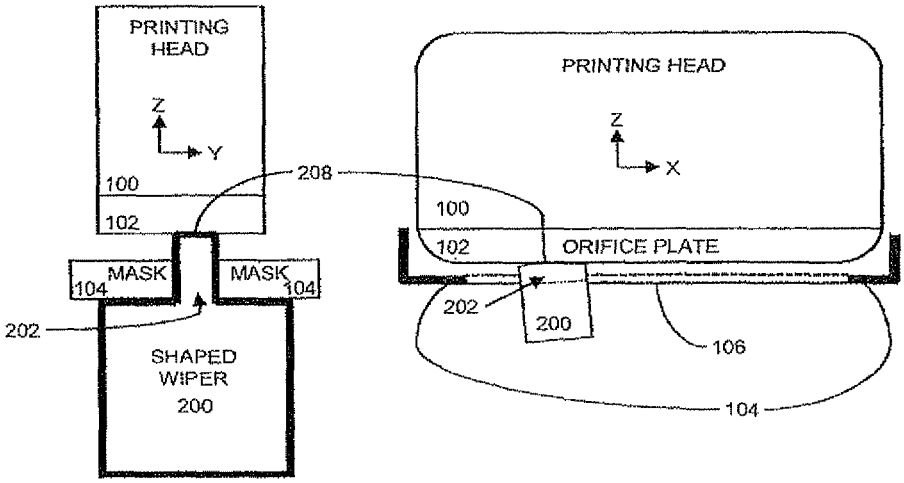
FIG. 4A, a side view of a printing system with shaped wiper.
FIG. 4B, a front view of a printing system with shaped wiper.

Referring to FIG. 4A, a side view of a printing system with shaped wiper, shaped wiper 200 has been inserted into slit 106 in mask 104. Slit 106 is not visible in the side view, as the tip of the shaped wiper occupies the entire width of the slit (refer to FIG. 1B, slit 106). In this case, the tip-width is substantially equal to the slit-width. Typically one or more shoulders 216 are in contact with at last one edge of the slit 106. Tip 202 extends through slit 106. Distal end 208 of tip 202 is in contact with the orifice surface provided by orifice plate 102.

Referring to FIG. 4B, a front view of a printing system with shaped wiper, shaped wiper 200 has been inserted into slit 106 and distal end 208 of tip 202 is in contact with the orifice surface provided by orifice plate 102. Note that the shoulders of the shaped wiper are not visible in FIG. 4B, as the shoulders are in the front/back (Y-axis) direction. The area of the shoulders in indicated on shaped wiper 200 by the dashed line, indicating where the tip meets the handling end.

A significant feature of the current embodiment is the configuration of the shaped wiper such that when one or more shoulders of the shaped wiper are in contact with the mask, and specifically in contact with respectively one or more edges of the slit, the tip applies a pre-determined pressure to the orifice surface. This feature facilitates a placing a shaped wiper against a mask, with the shoulders of the handling end preventing over-insertion. In other words, the shoulders prevent the tip of the shaped wiper from being pushed too far into the slit, which could result in a pressure in excess of the pre-determined pressure being applied by the tip to the orifice surface. As described above, avoiding excess pressure is desirable to preserve the smoothness and non-wetting characteristics of the orifice surface, protecting the non-wetting coating on the orifice surface. The shoulders also facilitate the tip applying sufficient pressure to the orifice surface, as applying insufficient pressure can result in non-uniform and improper wiping of the orifice surface. In other words, applying too little pressure or less pressure than the pre-determined pressure will not enable the wiping to reliably clean the orifice surface.

Note that for clarity in the current description, when referring to the tip applying a pre-determined pressure to the orifice plate, the tip is referred to as applying pressure, in the singular. One ordinarily skilled in the art will realize that the tip applies a pressure that can vary from one wiping to another wiping, the pressure of each wiping within an acceptable pre-determined range of pressures. The preferred minimum pressure is sufficient to remove buildup from the orifice surface. The preferred maximum pressure is below a pressure that allows the tip to cause damage to the orifice surface. A static pressure applied by the tip when in contact with the orifice surface may differ from the pressure during wiping (dynamic movement of the tip while in contact with the orifice surface). Any difference in pressure between static and dynamic contact between the tip and orifice surface should be within the predetermined range of pressures to remove buildup and prevent damage to the orifice surface. The innovative shape and use of a shaped wiper provides a tip that results in a pre-determined pressure range being applied by the tip to the orifice surface.

A typical slit-width 112 is 1 millimeter (mm). Larger values for the slit-width, such as 2 mm are possible. Note that the larger the slit aperture, the smaller the shielding effect is. Smaller values for the slit-width, such as 0.3 mm and even 0.1 mm are possible. The minimum possible value is equal to the nozzle diameter plus the uncertainty in the straightness of the slit and the ability to align the nozzle array in the slit without disturbing the jetting through the slit aperture. A practical limitation on the minimal value of slit aperture is the need to wipe (or scrub) the orifice plate from time to time. For periodic wiping, a shaped wiper should wipe the orifice through the slit, and hence the width of the tip of the shaped wiper width should be comparable to the slit width. 0.5 mm is a practical minimal width of the tip of such a shaped wiper. A preferred implementation for the tip-width 204 is to be equal to the slit-width. Since the production world always requires a specification of tolerance, a possible specification for tip-width is the slit-width plus ten percent of the slit-width: tip-width=slit-width+(0 to 10%). This specification reflects the fact that the wiper is flexible and the tip of the shaped wiper can fit into a narrower slit than the width of the tip of the shaped wiper. This possible specification also reflects the desire to assure wiping the full width of the orifice plate behind the slit. In a non-limiting example, a 1.1 mm tip-width is used to wipe a 1.0 mm slit.

Typically, the distance of the offset of the nozzles (orifices) from the edge of the slit is 120 microns (μm)+−30 μm. Because of the relatively small offset of the nozzles from the edge of the slit, assuring wiping of the entire orifice surface above the slit is important, hence the tip-width and tip-height are significant, if not critical, features for successful implementation of a shaped wiper.

In a case where the orifice surface has one or more orifices having an orifice-diameter (also referred to in the content of this documents as an orifice-width), preferably the tip-width 204 is at least as wide as the orifice-diameter, thereby allowing the orifices to be wiped by one pass of the tip of the shaped wiper.

Shield-depth 118, the distance between the surface of orifice plate 102 (the orifice surface) and the bottom of mask 104 is typically 0.4 mm plus or min 0.6 mm (shield-depth=0.4+−0.6 mm). The tip-height 206 is preferably the shield-depth plus 20% to 30% of the first height (tip-height=shield-depth+20% to 30%).

Preferably, the tip of the shaped wiper is made of an open-cell material, such as open-cell foam. Open-celled materials absorb liquids, facilitating the tip absorbing a cleaning liquid before wiping. During wiping, the cleaning fluid from the open-cells can be drawn out to the orifice surface to loosen and/or bind with the sediment buildup on the orifice surface. During wiping, open-cell foam facilitates drawing via capillary action the ink and sediment buildup into the open-cells of the tip, thereby removing the sediment buildup from the orifice surface.

As described above, the orifice plate is often coated with a non-wetting coating. The non-wetting coating may be easily scratched through improper wiping. Therefore, the tip of the shaped wiper should be sufficiently soft to prevent scratching, removal, and other damages to the non-wetting coating.

Preferable features of the open-cell foam used for the tip of the shaped wiper include, but are not limited to:

- not harming the delicate non-wetting coating of the orifice plate (chemically and physically),
- inert with respect to the aggressive dispersant,
- withstands the temperature of the head (40÷60 C),
- maintains flexibility,
- able to be manufactured with uniform tiny open cells,
- resistant to cutting (the edges of the slit are typically sharp,
- maintains size for the lifetime of use, and
- maintains substantially shape during wiping.

A preferable material for the tip of the shaped wiper is polyolefin.

Note that for ease of manufacturing, preferably, the entire shaped wiper is constructed from the same substance, preferably open-ell foam, as described above. Other construction techniques are possible, including a two-part shaped wiper, where the handling end and the tip are constructed from different materials and joined to form a complete shaped wiper. Also possible is to use materials for the tip other than open-cell foam. Based on this description, one skilled in the art will be able to select how many segments and of what materials to construct the shaped wiper for a specific application.

In an alternative embodiment, the tip-width 204 can be less than the slit-width 112. In this case, more precise positioning, control, and/or movement of the tip of the shaped wiper are required to perform wiping. In a non-limiting example, during a first wiping, the tip of the shaped wiper is in contact with a first edge of the slit, and during a second wiping, the tip is in contact with a second edge of the slit. As the width of the tip is less than the width of the slit, at least two wipings are needed to insure that all edges of the slit are wiped. In this case, a wiping is one movement, or pass, of the shaped wiper in the direction of the X-axis, in other words along the slit from one side of the slit in the direction of another side of the slit. A single wiper can be used multiple times, or multiple wipers can be used one or more times, depending on the application. Changing the orientation and/or angle of the tip of the wiper can also be used during multiple wipes to wipes all the areas desired to be wiped and/or use different portions of the tip for wiping. As will be obvious to one skilled in the art, in a case where the tip-width is less than the slit-width, the position of the nozzles in relation to the slit also needs to be taken into account for positioning and movement of the shaped wiper for wiping.

Figure 5A:
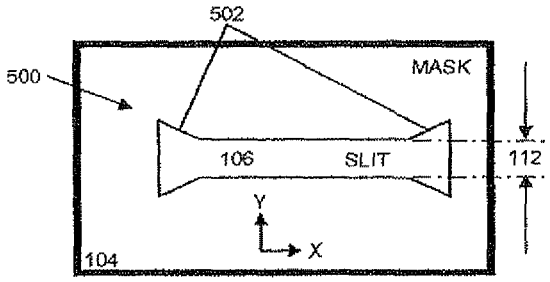
FIG. 5A, a diagram of a mask 14 with a short slit.
Figure 5B:
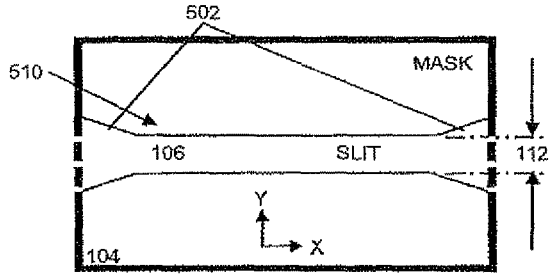
FIG. 5B, a diagram of a mask with a long slit.

Referring to FIG. 5A, a diagram of a mask 104 with a short slit 50 and FIG. 5B, a diagram of a mask 104 with a long slit 510, optionally short slit 500 and long slit 510 include one or more wider sections 502 on at least one corresponding side of the slit 106. The wider sections 502 are configured to accept the tip of the shaped wiper and guide the tip into the slit 106. In the case of "short slit" 500, the width of the slit 106 including the width of one or more wider sections 562 is less than the width of the mask. In the case of "long slit" 510, the width of the slit 116 including the width of one or more wider sections 502 is substantially equal to the width of the mask. A feature of the long slit 510 is a side of the slit being open to a side of the mask, allowing the tip to enter the slit from the side of the mask, in the plane of the orifice surface. Both short slits and long slits may have a single wider section on one side of the slit or more than one wider section, each wider section on a separate side of the slit. Preferably, the slit-length of the slit is longer than the length of the corresponding row of nozzles in the orifice plate, allowing room for insertion and removal of the shaped wiper when beginning and ending wiping of the orifice surface above the slit. Based on this description, one skilled in the art will be able to size the slit-length based on the size of the shaped wiper, desired contact of the tip to the orifice surface before and after wiping, and movement of the wiper to allow space for insertion and removal of the shaped wiper.

Figure 6A:
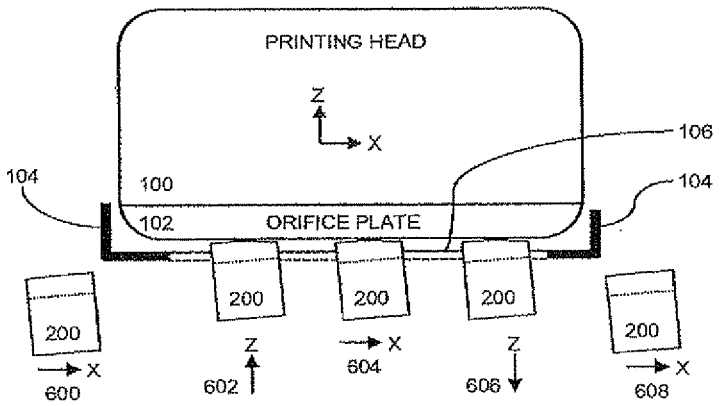
FIG. 6A, wiping via a short slit.
Figure 6B:
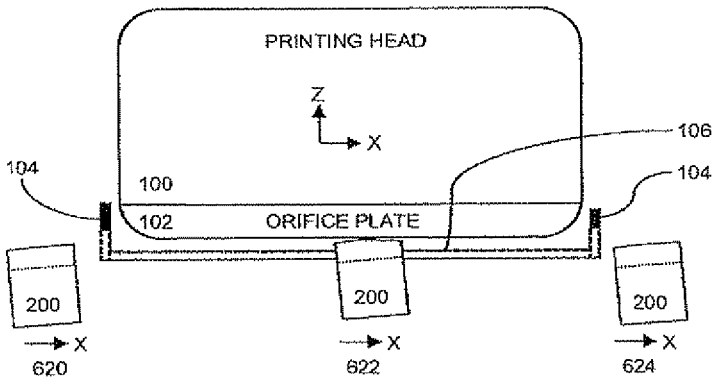
FIG. 6B, wiping via a long slit.

Referring to FIG. 6A, wiping via a short slit and FIG. 6B, wiping via a long slit, a method of printing includes inserting a tip of a shaped wiper 200 into a slit 106 of a mask 104, such that one or more shoulders of a handling end of the shaped wiper 200 are in contact with respectively one or more edges of the slit 106. When the shoulders are in contact with the edges of the slit, the tip applies a pro-determined pressure to an orifice surface of an orifice plate 102. The shaped wiper is moved relative to the orifice surface such that the tip wipes the orifice surface. Typically, the printing head is static and the shaped wiper is moved across the print head. The wiping is a relative movement between the shaped wiper and the orifice surface, as the shaped wiper can be static and the print head moved to perform wiping.

Referring to FIG. 6A, a non-limiting example of wiping via a short slit includes a shaped wiper 200 being moved into position below a printing head 100, shown as 600 in the direction of the X-axis. When the shaped wiper 200 is in the desired position below the slit, the shaped wiper is moved until the shoulders of the shaped wiper contact the edges of the slit, thereby inserting the tip from the bottom of the slit into the slit, and the tip contacting the orifice surface with a pre-determined pressure (shown as 602 in the direction of the Z-axis). The tip is inserted into the slit while the tip moves orthogonally to the bottom surface of the printing mask.

While maintaining the shoulders of the shaped wiper in contact with the edges of the slit, the tip is in contact with the orifice plate at the pre-determined pressure. The shaped wiper is moved relative to the orifice surface such that the tip wipes the orifice surface, shown as 604 in the direction of the X-axis. After a pass is completed, and the orifice plate has been wiped, the shaped wiper is moved away from the printing head, thereby removing the tip from the slit, shown as 606 in the direction of the Z-axis. The shaped wiper can then be moved out from below the printing head 100, shown as 608 in the direction of the X-axis.

Referring to FIG. 6B, a non-limiting example of wiping via a long slit includes a shaped wiper 206 being moved into position beside a printing head 100, shown as 624 in the direction of the X-axis. Wiping via a long slit is similar to wiping via a short slit, however the tip of the shaped wiper can enter the slit via the side of the slit, without requiring movement in the up/down (Z-axis) direction. The tip of the shaped wiper enters the slit 106 via the side of the slit. The tip is inserted into the slit while the tip moves in the direction of the slit (in the direction of the X-axis). The shoulders of the shaped wiper contact the edges of the slit, thereby inserting the tip into the slit, and the tip contacting the orifice surface with a pre-determined pressure. While maintaining the tip in contact with the orifice plate at the pro-determined pressure, the shaped wiper, is moved relative to the orifice surface such that the tip wipes the orifice surface, shown as 622 in the direction of the X-axis. After a pass is completed, and the orifice plate has been wiped, the tip is removed from the slit via a side of the slit, and moved out from below the printing head, shown as 624 in the direction of the X-axis. The need for movement of the shaped wiper in the direction of the Z-axis, for pressing the shoulders of the shaped wiper against the mask, can be avoided by designing the mask with a slanted bottom surface.

Preferably, during wiping the tip is also in contact with the edges of the slit, thereby both cleaning the edges of the slit during wiping, and verifying cleaning of the complete orifice surface that is behind the slit.

Wiping can include one or more passes in the same or alternating directions, with or without removing the tip from the orifice surface. Alternatively, a portion of the orifice surface can be wiped. In a non-limiting example only a portion of the nozzles are being used and only the portion of the orifice surface corresponding to the nozzles being used is wiped. In another non-limiting example, wiping may fail to remove buildup from a portion of the orifice surface, and repeated side-to-side wiping of that portion of the orifice surface is used to scrub the buildup from that portion of the orifice surface.

Note that a shaped wiper can be used for wiping without the shoulders pressing against the edges of the slit. As the dimensions of the shaped wiper are known, in particular the height of the handling end and the height of the tip (tip-height), the handling-end can be manipulated in relation to the slit and/or orifice surface such that the tip applies a pro-determined pressure to the orifice surface, without the need for the shoulders of the handling end to be in contact with the edges of the slit. As will be obvious to one skilled in the art, using a wiper without specifically designed shoulders in contact with the edges of a mask slit presents additional difficulties that must be addressed for wiping.

In a preferred embodiment, the slit includes a wider section 502, as described in reference to FIG. 5A and FIG. 5B, and inserting a tip includes inserting the tip via a wider section on a side of the slit. The wider section is configured to accept the tip of the shaped wiper and guide the tip into the slit. In a case where a slit has one wider section on a first side of the slit, the tip is typically inserted via the wider section and wiping is from the first side to an opposite side of the slit. In a case where a slit has a wider section on both sides of the slit, the tip can be inserted via either of the sides, with wiping from the side of insertion to the opposite side of the slit.

Figure 7A:
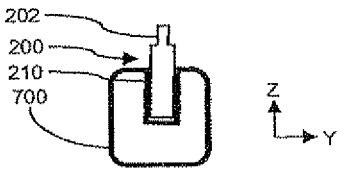
FIG. 7A, a side view of a holder for a shaped wiper.
Figure 7B:
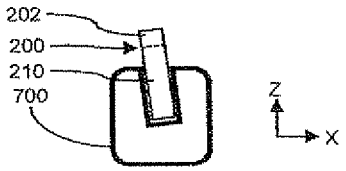
FIG. 7B, a front view of a holder for a shaped wiper.

Referring to FIG. 7A, a side view of a holder for a shaped wiper, and FIG. 7B, a front view of a holder for a shaped wiper, one embodiment of a holder 700 is shown. Holder 700 at least partially surrounds handling end 210 of the shaped wiper 200. At least tip 202 extends from holder 700. Movement of holder 700 can be used to position the shaped wiper via the handling end 210, specifically allowing tip 202 to be inserted into a slit.

Figure 8A:
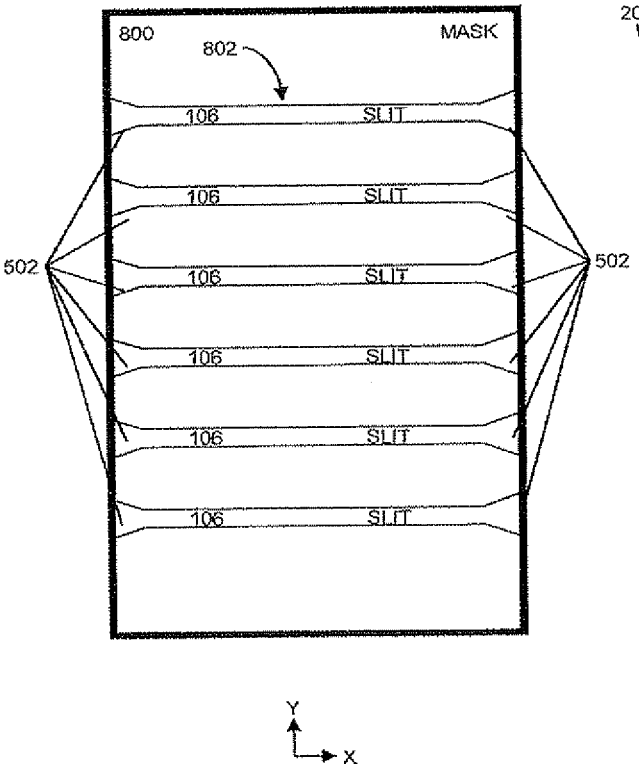
FIG. 8A, a diagram of a mask with multiple slits.

Referring to FIG. 8A, a diagram of a mask with multiple slits, a mask 800 can have multiple slits 802, as compared to example mask 104 (refer back to FIG. 1A-1D) which has a single slit 106. The non-limiting example of mask with multiple slits 800 has six slits. Each of the slits is shown with optional wider sections 502 on each side of the slit 106. Typically, the multiple slits 802 are aligned in the direction of the Y-axis. Scanning and wiping is in the direction of the slit-length that is in the direction of the X-axis.

Figure 8B:
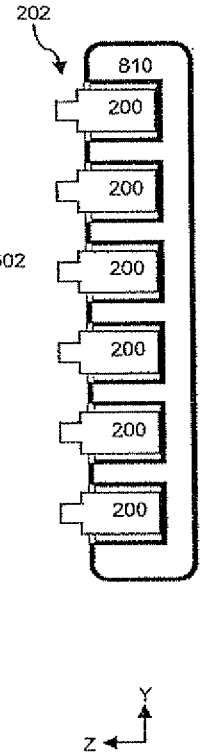
FIG. 8B, a diagram of a multiple-holder for shaped wipers.

Referring to FIG. 8B, a diagram of a multiple-holder 810 for shaped wipers, six shaped wipers 200 are held in a single multiple-holder 810. This non-limiting example of a multiple-holder for more than one shaped wiper can be used with example mask with multiple slits 800, the multiple-holder designed such that each of the shaped wipers 200 of the multiple-holder 810 is aligned with one of the slits 106 of the multiple slits 802. Note that the multiple-holder 810 is shown with the shaped wipers aligned in the direction of the Y-axis, corresponding to the alignment of the multiple slits 802, and the tips 202 of each of the shaped wipers in the direction of the Z-axis.

Optional use of a holder can assist in positioning the shaped wiper before wiping, during wiping, after wiping, and during non-wiping periods. A holder can provide a mechanism to manipulate a relatively small shaped wiper, as compared to the large size of the apparatus required to perform the manipulation. The holder can also provide a replaceable unit for easier and quicker replacement of shaped wipers, as compared to having to individually replace, position, and check each shaped wiper.

Figure 9A:
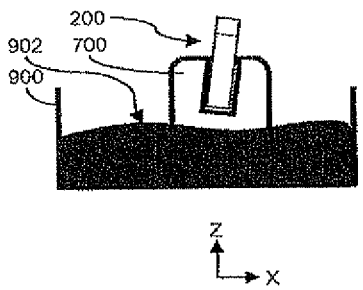
FIG. 9A, a diagram of a shaped wiper holder with bath.

Referring to FIG. 9A, a diagram of a shaped wiper holder with bath, during non-wiping periods a bath 900 with fluid 902 can be provided for the shaped wiper 200. Non-wiping periods are times when the printing head is in normal use, jetting ink, and printing to a substrate. During non-wiping periods, the shaped wipers and related components, such as holders, are removed from the area under the print head, which is the area between the print head and the substrate.

Figure 9B:
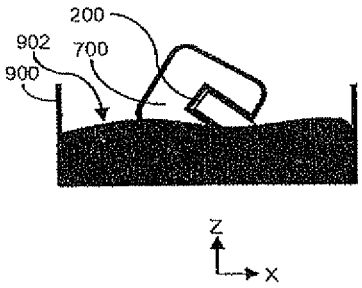
FIG. 9B, a diagram of a shaped wiper with tip in a fluid bath.

Referring to FIG. 9B, a diagram of a shaped wiper with tip in a fluid bath, holder 700 has been rotated so that at least the tip (not shown) of the shaped wiper 200 is submerged in the fluid 902 of the bath 900. In this non-limiting example, the holder is rotated around the Y-axis (In the X-Z plane) to submerge the tip of the shaped wiper in the fluid 902 of the bath 900.

Preferably, during non-wiping periods at least the tip of the shaped wiper is stored in a fluid 902. Choices of fluid include, but are not limited to cleaning liquid, and printing liquid (ink). The fluid is selected to prevent the tip from becoming dry, which could lead to an increased chance of scratching or otherwise damaging the orifice surface, as described above. The fluid can also facilitate removing ink from the tip (in the case where the fluid is a cleaning fluid) or at least keeping the ink on the tip moist (as in the case where the fluid is ink). In a case where sediment that was removed during wiping is on the tip, immersion in a fluid facilitates the sediment leaving the tip of the shaped wiper. Removal of buildup, sediment, and other abrasives from the tip allows the shaped wiper to be used multiple times for wiping.

Figure 10:
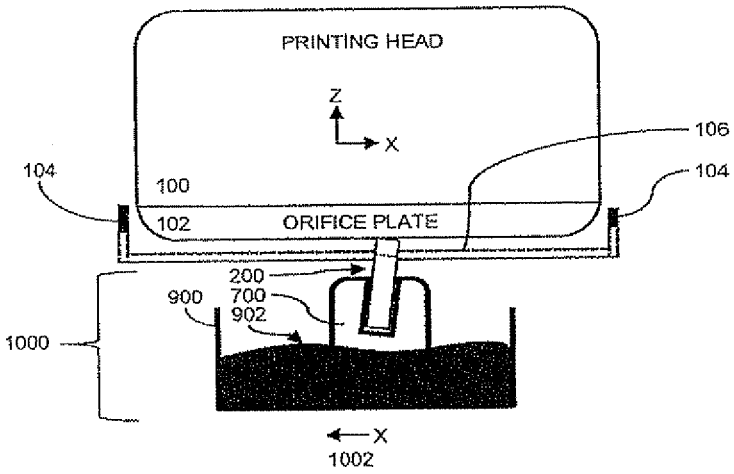
FIG. 10, a diagram of a shaped wiper with bath replaceable unit.

Referring to FIG. 10, a diagram of a shaped wiper with bath replaceable unit 1000 includes one or more shaped wipers 200 in corresponding holder(s) 700 with bath 900 containing a fluid 902. As a non-limiting example in the current figure, the wiping is shown as 1002 in the (negative) direction of the X-axis. The replaceable unit 1000 can be a discrete system component providing a replaceable unit for easier and quicker replacement of shaped wipers, as compared to having to individually replace, position, and check each shaped wiper, install holders in baths, and/or replace fluid in a bath. One skilled in the art will be able to select and match a material for the shaped wiper with fluid for the bath and the lifetime wiping requirements of the shaped wiper for a specific application. Preferably the lifetime of the shaped wiper is matched to the type and amount of fluid in the bath (and correspondingly the size of the bath), facilitating an economical replacement of the entire replaceable unit 1000.

In an alternative implementation, the bath can be provided as a separate component from the shaped wiper. In this case, during periods of non-wiping, the shaped wiper is moved to the bath and at least the tip of the shaped wiper is immersed in a fluid in the bath. In a non-limiting example, the shaped wiper is mounted in a holder, and the holder is moved, thereby moving the shaped wiper to the bath. The holder can then be moved and/or rotated to immerse the tip of the shaped wiper in the fluid of the bath.

The fluid can be provided with the bath or separately from the bath. In a non-limiting example, the bath is a disposable container containing fluid. When a new bath is needed, the bath is opened, and the fluid used. When the fluid can no longer be used, for instance when the quality, cleanliness, and/or effectiveness is below a desirable level, the bath and fluid can be disposed of, or preferably recycled. In another non-limiting example, the bath is a multi-use container. When old fluid in the bath can no longer be used, the old fluid is removed from the bath (disposed or recycled), optionally the bath container cleaned, and the bath re-filled with new fluid.

Second Embodiment

FIGS. 11 to 20

While the above-described embodiment for cleaning an orifice plate is useful, an additional technique can be used in conjunction or independently, for preventing sediment buildup during non-printing times with increased efficiency for inkjet head maintenance, as compared to conventional techniques. As described above, during an extended period of non-printing, the liquid portion of ink that remains on the nozzles can evaporate, leaving behind sediment. In the context of this document, the terms "extended period of non-printing" and "long time" are generally used interchangeably to refer to an amount of time sufficient for residual ink on a printing head to dry, such that there is sediment buildup on the printing head.

An innovative method for preventing sediment buildup during extended periods of non-printing includes placing at least the orifice plate of the printing head in a protecting liquid that avoids evaporation of the volatile liquid from the nozzles, thereby preventing sediment buildup on the printing head. Preferably, the protecting liquid is the printing ink. In the context of this document, this innovative technique is referred to as an "ink retainer", "ink bath", or "ink retention mechanism".

In a case where a printing mask is being used, an innovative "night plate" can be used to seal the slit and facilitate the printing mask being used as an ink retainer. After sufficiently sealing the slit using the night plate, ink is purged from the printing head to fill a gap between the printing head and the mask, thereby covering at least the orifice plate with the purged ink. The purged ink acts as a protecting fluid, preventing evaporation of ink from the orifice surface, hereby preventing sediment buildup on the printing head.

Testing has shown that using the ink retainer and/or night plate method and device, a printing head can be maintained without nozzles becoming clogged during a non-printing period of a week, which is a longer amount of time than typical non-printing periods. One test was done with a high quality ink (home made) including a solvent as the carrier fluid (designated liquid carrier), silver nano-particles (50% weight ratio of silver to complete dispersion), and dispersing agent. The viscosity at room temperature was 25 to 30 centipoise. Obviously, when using lower grade ink, one that tends to discharge sediments, the head may be clogged after a smaller period of non-printing when being immersed in ink without flow. An optional solution including an ink circulation in bath is described below.

Depending on the application, a variety of fluids can be used as the protecting fluid. Preferably, the protecting fluid is the printing fluid, or in other words, the ink being used for printing. Ink is readily available from the printing head, and is obviously compatible with the ink used for priming. Using a fluid other than ink can present a variety of problems that will need to be overcome for resuming printing at a typical quality required for printing. One problem when using a protecting fluid other than ink, such as a wetting or cleaning fluid, is that the wetting or cleaning fluid can enter (back-up) the nozzles and mix with the printing ink. This mixture of printing ink and wetting or cleaning fluid needs to be purged before printing can resume. If a carrier fluid (the carrier fluid for the printing ink) is used as a protecting fluid, back-up of the carrier fluid into the nozzles can change the density of the printing ink inside the printing head, which can require purging of the printing head prior to resuming printing.

Conventional techniques for protecting nozzles during periods of non-printing include attaching a rubber or other material to the orifice surface. In order to prevent sediment buildup, the rubber or other material is soaked with a cleaning or wetting fluid. As described above, conventional methods suffer from the cleaning or wetting fluid backing-up the nozzles and mixing with the printing ink. A feature of the current embodiment is using purged ink for the protecting fluid.

Figure 18:
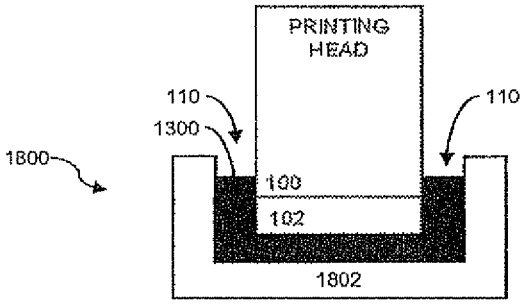
FIG. 18, a diagram of a printing head with ink retainer.

Referring to FIG. 18, a diagram of a printing head with ink retainer, a printing system includes a printing head 100 with an orifice surface 102. An ink retainer 1800 is configured so that when at least a portion of the ink retainer is at least partially filled with printing ink, the printing ink is in contact with substantially all of the bottom of the orifice surface 12. The orifice surface is thereby kept wet during periods of non-printing. The printing system can include a positioning mechanism (not shown) operable to configure the ink retainer relative to the printing head. In a first state, during periods of non-printing the positioning mechanism positions the ink retainer relative to the printing head such that the printing ink is in contact with substantially all of the orifice surface. In a second state, during printing, the positioning mechanism positions the ink retainer relative to the printing head such that ink can be jetted from the orifice surface to a substrate. The ink retainer can be filled with protecting fluid, preferably printing ink, before being positioned in the first state, or after being positioned in the first state. When the ink retainer is in the first state, the orifice surface is immersed in the printing ink. Immersion of the orifice surface include relatively positioning the orifice surface into the printing ink, or alternatively flooding the orifice surface with printing ink. Flooding the orifice surface with ink can be done by dispensing ink from the head trough the orifices (i.e. purging) into the ink retainer. When the ink retainer transitions from the first state (non-printing) to the second state (printing), the orifice surface is immersed from the printing ink. The ink used for immersion is preferably the same ink used for printing. Various implementations of the positioning mechanism we possible depending on the specific requirement of the printing system. Typically, the positioning mechanism is automated, including but not limited to a robotic arm or automated transfer mechanism. The ink retainer and/or the printing head can also be manually positioned relative to each other and relative to other components of the printing system.

In the non-limiting example of FIG. 18, ink retainer 1800 includes ink bath 1802. When the orifice surface is kept wet, drying of the liquid at the orifice outside is prevented (as discussed above). When the ink includes a dispersion of small solid particles, and especially when the particle are of "nano" dimension (i.e. particles of size no more than few tenths of a nanometer), there is an additional impact on the printing system: The small solid particles constantly move in random direction due to Brownian motion. When the orifice is immersed in an ink bath, the particles freely move from the inside of the head to outside and vice versa. This motion prevents or slows down sedimentation. Gap 110 between the walls of the bath and the printing head provides a portion of the ink retainer 180 that can at least partially filled with protecting fluid 1300. In this case, the protecting fluid is printing ink.

Note that for clarity in the figures, orifice surface 102 is shown with a height, but practically the height of the orifice surface is small relative to the other dimensions of the printing system. One skilled in the art will understand that references to the protecting fluid being in contact with the orifice surface should generally be understood as referring to contact of the bottom surface of the orifice surface. Practically, the orifice surface will need to be surrounded by the printing ink to insure that the bottom surface of the orifice surface maintains contact with the printing ink.

Bath 1802 can be at least partially filled with the printing ink prior to the bath surrounding the orifice surface 102. Alternatively, the bath can be at least partially filled with the printing ink after the bath surrounds the orifice surface. Preferably, ink for filling the bath is provided by purging ink from the printing head.

Other implementations of an ink retainer 1800 can be implemented, depending on the specific requirements of the application. In an alternative implementation, ink retainer 1800 includes open-cell foam. The open cell foam is at least partially filled with printing ink prior to the open-cell foam contacting the orifice surface, or after the open-cell foam is in contact with the orifice surface. Preferably, the open cell foam is at least partially filled with printing ink purged from the printing head.

Ink used for typical inkjet printing applications contains particles, as described above. In a non-limiting example an ink containing heavy metal particles is used to deposit electric or heat conducting lines on glass, electronic printed circuit boards (PCB-s), semiconducting devices, and other substrates. A non-limiting example of such an ink is an ink for metallization of photovoltaic wafers used in solar energy, mentioned above. The ink typically includes a solvent as the liquid carrier (carrier fluid), silver nano-particles (50% weight ratio of silver to complete dispersion), and dispersing agent. When such ink with particles sits for an extended period, the particles can settle out of the carrier fluid. This settling phenomenon may be harmful for the printing head, since particle settling out of carrier fluid means creating harmful sediments in the tiny inner tunnels and compartments of the head. Particle settlings prevented when the ink flows and agitates. The current invention uses flowing and/or agitating of the ink to prevent particle settling. In this embodiment, the ink periodically flows during periods of non-printing (rest time) through the ink system or part of the printing system, including printing head, ink pipes, ink reservoir, and ink bath. An option is to constantly circulate the ink through entire ink system. An embodiment of the periodic option may be first removing the ink (pumping, sucking, suctioning) from the ink bath 1802 (cradle) on a periodic basis, and then re-purging from the print head to replace the protection fluid (printing ink). Depending on the application, all of the ink can be removed from the bath, and the bath can be refilled with new ink, or additional ink can be added to the bath. Depending on the size of the bath, when additional ink is added, a portion of the ink previously in the bath can be removed. Re-purging and/or circulation prevents settling out of particles and prevents sediment buildup. Re-purging and/or circulation are preferably done on a periodic basis, with the period of re-purging and/or circulation determined by the requirements of the specific application. In a particular application of printing metal lines on photovoltaic wafers by inkjet heads (using ink including a dispersion of 50% nano-silver particles by weight in a solvent fluid carrier) this method and system was successfully implemented using a periodic circulation activated every 30 minutes.

Figure 19:
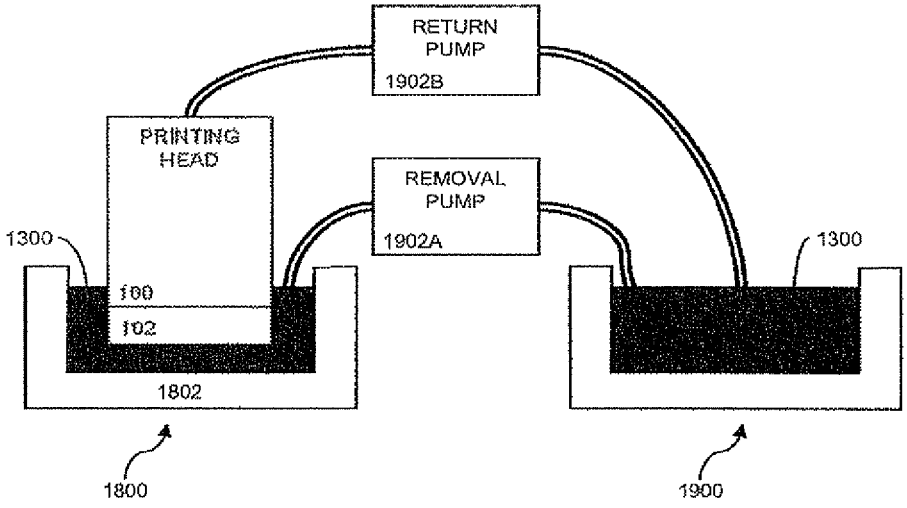
FIG. 19, a diagram of an ink retainer with ink bath and circulating mechanism.

Referring to FIG. 19, a diagram of an ink retainer 1800 with ink bath 1802 and circulating mechanism, printing ink can be repeatedly removed from the ink bath. In the non-limiting example of FIG. 19, a mechanism such as removal pump 1902A is used to remove ink 130 from the ink bath. Removed ink is preferably stored in an ink storage location 1900 for re-use. The removed ink is thus made available for filling the ink bath 1802. Depending on the application, the ink cleaning (suctioning) system can preferably be used to remove ink from the ink bath.

Optionally, the removed ink can be re-circulated or new ink can be provided to the ink retainer 1800. A mechanism, such as one or more return pumps 1902B, is used to return printing ink 1300 from the ink storage location 1900 for use in the ink retainer 1800.

The ink retainer 180 can be filled repeatedly with the printing ink. Preferably, the ink retainer is filled repeatedly by purging ink from the printing head. At least a portion of the printing ink can be removed from the ink retainer, and at least a portion of the removed ink can be made available for filling the ink retainer. Obviously, when purging or otherwise refilling the ink bath 1802, the ink bath should be filled with sufficient printing ink to cover the (bottom surface of) the orifice plate.

In some applications, the printing ink is too viscous as compared to the viscosity required by the printing head specification. In such cases, the printing system deliberately heats the printing head to a predetermined temperature that lowers the viscosity of the printing ink and enables proper operation of the printing head. Daring long periods of non-printing, the printing head usually is at room temperature the printing ink is too viscous to be urged from the printing head. In this case, a technique that can be used to allow the printing ink to be purged is to heat the printing head to the required temperature to lower the viscosity of the printing ink and allow purging of printing ink from the printing head. Typically, heating the printing head can be done during the period of non-printing a few seconds or minutes before a purge is to be performed. The amount of time necessary to heat the printing head will depend on the application. After purging, the printing head can be allowed to return to room temperature until the next purge.

In applications requiring a printing mask, a short slit is typically preferred. A short slit typically enables a greater area of the printing head, in particular the orifice surface, to be protected (from heat, etc. as described above), as compared to using a long slit. Using a short alit is preferred when using a night plate, as a short slit can be completely covered by a sealing element of the night plate.

Figure 11A:
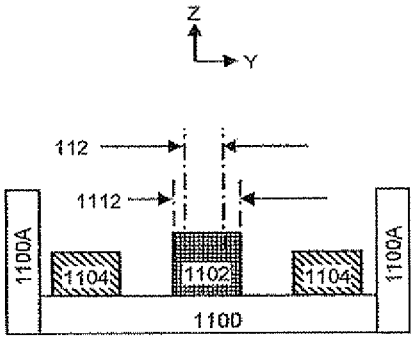
FIG. 11A, a side view of a night plate.

Referring to FIG. 11A, a side view of a night plate, an attachment mechanism 1100 includes connecting portions 1100A, a resilient sealing element 1102, and optionally at least one stopper 1104. The width 1112 (in the direction of the Y-axis) of the sealing element 1102 is preferably larger than the slit-width 112. A night plate is a preferred implementation of an ink retainer 1800.

Figure 11B:
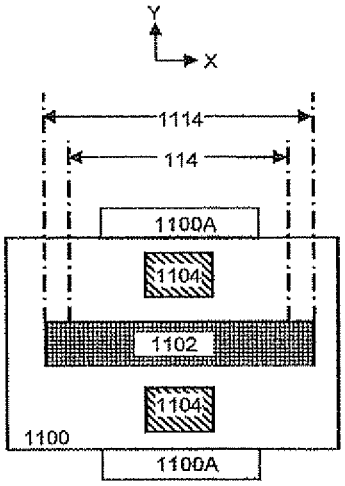
FIG. 11B, a top view of a night plate.

Referring to FIG. 11B, a top view of a night plate, the attachment mechanism 1100 includes connecting portions 1100A, a resilient sealing element 1102, and optionally at least one stopper 1104. The length 1114 (in the direction of the X-axis) of the sealing element 1102 is preferably larger than the slit-width 114. Using a short-slit and a sealing element with greater width and length than the short slit facilitates the sealing element completely covering the slit, thereby preventing a protecting fluid from going through the slit.

Figure 12:
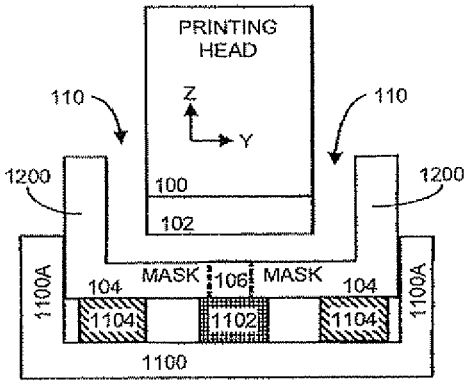
FIG. 12, a printing system with night plate includes a sealing element.

Referring to FIG. 12, a printing system with night plate includes a sealing element 1102, and an attachment mechanism (1100, 1100A). The attachment mechanism 1100 is configured to position the sealing element 1102 in contact with a slit 106 of a mask 104. The sealing element 1102 is at least in contact with substantially all of the slit 106. Note that one skilled in the art will realize that references to contact with the slit generally refer to contact with the edges/area adjacent to and surrounding the slit, as well as the void of the slit. The sealing element 1102 contacts the slit 106 on a bottom side of the mask 104. The contact has a sealing pressure sufficient for preventing a fluid on a top-side of the mask 104 from going through the slit 106 to the bottom-side of the mask 104. The sealing element is resilient and preferably compressible. Thus, under pressure the sealing element compresses and fits to the area of the slit on the bottom surface of the mask. As described above in reference to FIGS. 1A-1C, the top-side of the mask faces the orifice surface 102 and is opposite the bottom-side of the mask. The currently described configuration of the sealing element and the attachment mechanism are referred to in the context of this document as a night plate.

A feature of the current embodiment is that the attachment mechanism (1100, 1100A) aligns a sealing element with a slit so that when the night plate is attached to a mask (typically of a printing head), the sealing element sufficiently seals the slit so that a protecting liquid cannot flow through the slit.

To prevent a protecting liquid from flowing through the slit, preferably the scaling element 1102 is non-porous material, such as a closed-cell foam. A material such as soft silicone closed-cell foam may be used for this purpose. RT-800 5 mm thick by Rogers Corp, II, USA has been successfully used in implementations of the current invention. In a case where rubber is used as the sealing element, the rubber can be of a type manufactured with a closed-cell surface. Alternatively, a skin, or covering, providing a closed-cell surface, can be put over the rubber to provide the closed-cell surface. A desirable feature of the sealing element is flexibility, in particular maintaining sufficient flexibility over the lifetime of the sealing element to enable the sealing element to conform to the slit and sufficiently seal the slit to prevent a protecting liquid from flowing through the slit.

Note that for clarity in the current description, when referring to the sealing element contacting the slit with a sealing pressure, the sealing pressure, in referred to in the singular. One ordinarily skilled in the art will realize that the sealing element contacts the slit with a sealing pressure that can vary within an acceptable pro-determined range of pressures. The sealing pressure is selected from an acceptable predetermined range of pressures. The preferred minimum pressure is sufficient so that a protecting liquid cannot flow through the slit. The preferred maximum pressure is below a pressure tint allows the sealing element to cause damage to the mask, or damage to be caused to other elements of the system, such as the attachment mechanism and/or connecting portions.

One skilled in the art will realize that the sealing pressure can be reduced to allow fluid to flow from the top-side of the mask through the slit to the bottom-side of the mask. Alternatively, the size of the sealing element can be reduced to not cover substantially all of the slit. In these cases, the flow rate of the fluid should be small enough so that the amount of fluid flowing through the slit during non-printing periods will not interfere with the printing process. One skilled in the art will realize that this implementation adds a number of problems which must be handled, including but not limited to, additional cleaning of the bottom of the mask prior to resuming printing, preventing or handling even minimal dripping from the night plate, and cleaning the night plate. A preferred implementation, as described above is to configure the night plate to use sufficient sealing pressure to prevent fluid from flowing through the slit during non-printing periods. Alternatively, there may be benefit to designing a system to work with a less effective night plate, as this could allow the night plate to be used for a longer time, even when the sealing element of the night plate becomes less effective due to aging of night plate apparatus components.

Excess pressure of the sealing element on the slit could potentially damage the slit, mask, sealing element, and/or night plate. Therefore, a preferable implementation includes a mechanism to prevent the sealing element from contacting the slit with excess pressure, or in other words a stopper. One or more stoppers 1104 are configured as part of the night plate to prevent the sealing element 1102 from contacting the slit 106 with excess pressure when the sealing element 1102 is in contact with the slit 106. Note that one skilled in the art will realize that references to the sealing element being in contact with the slit practically refer to the sealing element being in contact with the border of the slit, which is the area of the mask surrounding the slit.

Referring again to FIG. 12, a preferable implementation of mask 104 includes edges 1260 surrounding the bottom portion of the printing head 100, including surrounding at least the orifice plate 102. A mask with edges surrounding a printing head is also referred to in the industry as a cradle. The cradle forms a gap 110 between the mask 104 and the printing head 100.

Figure 13:
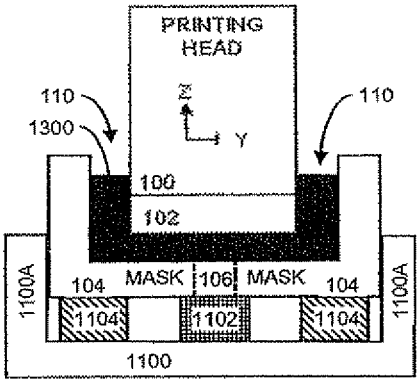
FIG. 13, a diagram of a printing head with night plate and protecting fluid.

Referring to FIG. 13, a diagram of a printing head with night plate and protecting fluid, sealing element 1102 is in contact with slit 106, and gap 110 has been filled with a protecting fluid 1300. In this case, the use of a cradle allows gap 110 to be filled sufficiently for protecting fluid 1300 to cover at least the orifice surface 102 of the printing head 100. The protecting fluid 1300 is preferably purged ink from the printing head.

At the end of a non-printing period, the ink is removed from around the printing head, uncovering the orifice plate. The printing head is prepared for use, and the night plate is detached from the printing head. As appropriate to the application, removal of the night plate and preparing the printing head for use may include optional steps performed in varying order for returning the printing head to printing.

Depending on the application, a variety of methods can be used to remove ink from the gap. In one implementation, an ink removal system is configured to remove the ink from the gap. Removing the ink is also referred to in the industry as "sucking" the ink from the printing head and/or orifice surface. A preferred ink removal system is a vacuum system. For sucking the ink, a variety of techniques can be used depending on the specific application. Refer to the World Intellectual Property Organization (WIPO) application *Printing system with an integrated self-purge arrangement,* 1811/051934 filed 2 May 2011 that teaches techniques for sucking ink that can be used with the present invention. Based on the current description, one skilled in the art will be able to implement mechanism for suctioning the protecting liquid from the printing head prior to removal of the night plate.

Figure 14:
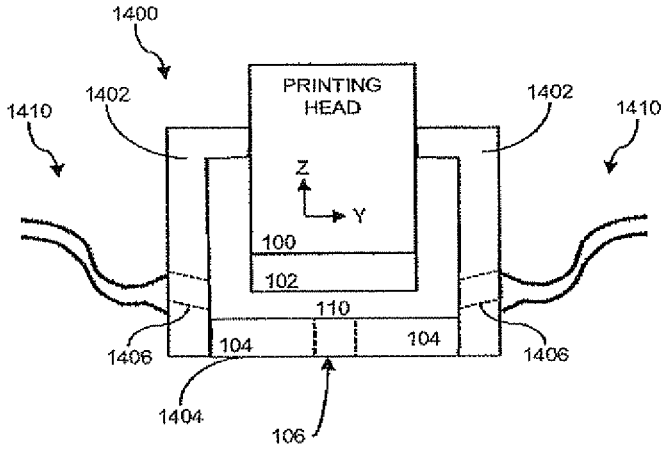
FIG. 14, a diagram of a mechanism for clearing purged liquid.

Referring to FIG. 14, a diagram of a mechanism for clearing purged liquid, shows a non-limiting example of a mechanism for suctioning the protecting liquid. The printing head 100 includes a printing head housing 1400, also simply known as a housing, which partially encloses printing head 100. Note that in the art a print head housing 1400 is also sometimes referred to as a "mask", but should not be confused with mask 104, as used in this document. Printing head housing 1400 can be implemented using the above-described mask 104. Housing 1400 includes a side portion 1402 (edges 1200 from FIG. 12) that surrounds the sides of printing head 100. A bottom portion 1404 also known as the floor, of housing 1400 functions as mask 104 and partially encloses orifice plate 102. Housing 1400 includes one or more suction ports 1406 connected to a vacuum system 1410. The suction ports 1406 facilitate the purged liquid being suctioned from gap 110 out of the housing 1400.

At the end of a non-printing period, after the ink is removed from around the printing head and additional optional preparations have been completed, the night plate is detached from the mask. In other words, the night plate is moved to a detached configuration such that the night plate is configured to allow jetting of ink from the inkjet printing head through the slit. In the context of this document, the term "detachable" when used in reference to a nightplate, such as "detaching the nightplate", or "a detachable nightplate", refers to detaching the sealing element 1102 from the slit 106, or in other words, moving the night plate relative to the mask 104 such that the slit is no longer sealed, and printing can occur. Note that the night plate does not have to be removed from the printing head in order to detach the night plate. For example, the nightplate can be rotated to detach the sealing element 1102 from the slit 106 and move the nightplate from below the printing head. In this case, the nightplate can remain connected to the printing head, or be removed from the printing head. In general, depending on the specific application, the nightplate can be removed from the printing head, or the nightplate can remain connected to the printing head but be positioned so as not to interfere with printing.

Similarly, in the context of this document, the term "attached" when used in reference to a nightplate, such as "attaching the nightplate", refers to positioning the sealing element 1102 in contact with the slit 106 such that the slit is sealed sufficiently so that a protecting liquid cannot flow through the slit. Note that the night plate does not have to be connected to the printing head in order to be attached to the night plate. For example, the nightplate may already be connected to the printing head, and the night plate is rotated to attach the sealing element 1102 to the slit 106. Depending on the specific application, the night late can be removed from the printing head when not being used, and connected to the printing head in order to be attached to the night plate. For example, the nightplate may already be connected to the printing head, and the night plate is rotated to attach the scaling element 1102 to the slit 106. Depending on the specific application, the nightplate can be removed from the printing head when not being used, and connected to the printing head during non-printing periods, or the nightplate can remain connected to the printing head but be positioned so as not to interfere with printing.

Figure 15:
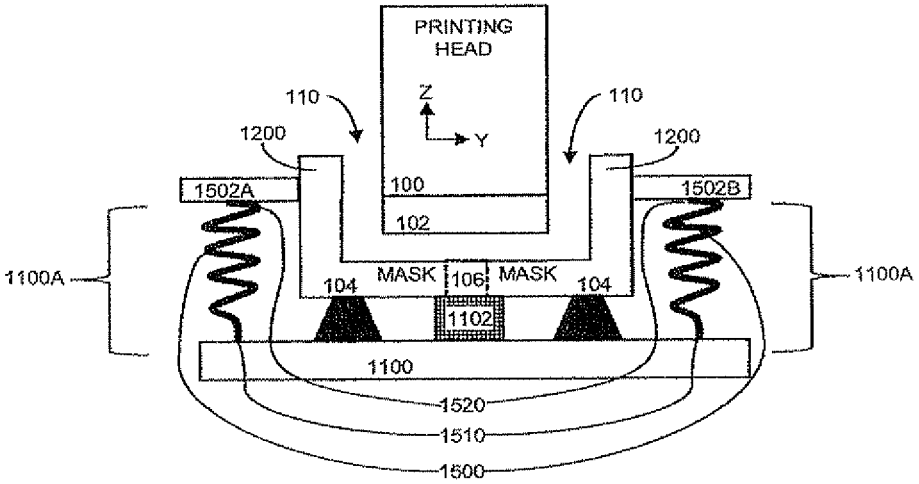
FIG. 15, a diagram of a spring mechanism connecting portion.

Referring to FIG. 15, a diagram of a spring mechanism connecting portion, the attachment mechanism 110 implements connecting portions 1100A as spring 1500. The attachment mechanism 1100 includes at least two spring 1500. A first end 1510 of each of the spring is mounted on opposite sides of the sealing element 1102. In the attached configuration, a second end 1521 of each of the springs is connected to the mask. Note that as the mask is typically connected to the printing head, in cases where the attachment mechanism is connected to the mask, the attachment mechanism can be equivalently described as being attached to the printing head. Optionally, the mask 104 includes one or more additional portions (1502A, 1562B) to serve as locations for connecting the attachment mechanism(s) to the printing head. In FIG. 15, the second end 1520 of each of the spring is connected to the mask via additional portions (1582A, 1502B). Stoppers 1504 are configured to allow sealing element 1102 to contact slit 186 with sufficient sealing pressure and to prevent contact with excessive pressure, as described above. In the example implementation of FIG. 15, the spring attachment 1500 requires that the nightplate be removed from the printing head to detach the nightplate.

Note that the exterior shape and configuration of the mask can be changed to provide accommodations for connecting elements of the attachment mechanism. In a non-limiting example, the mask (or equivalently the printing head) includes additional portions (1502A, 1502B) suitable for connecting the applicable elements of the attachment mechanism.

Figure 16A:
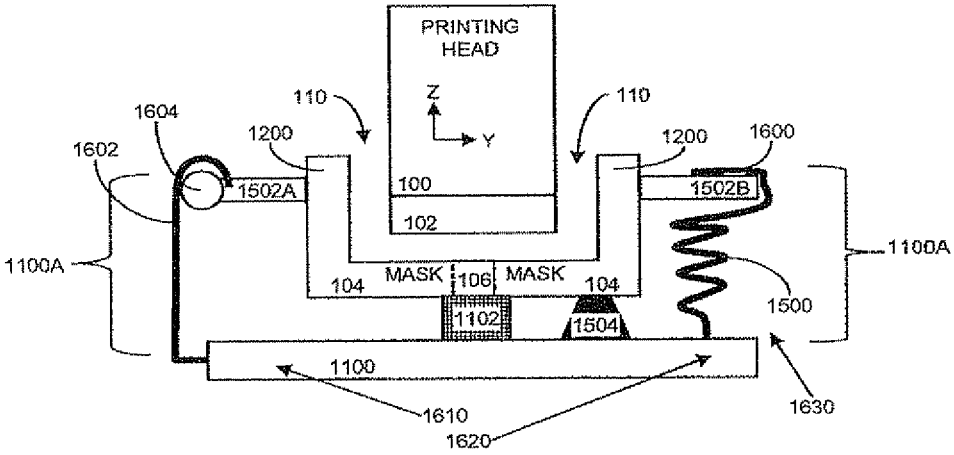
FIG. 16A, a diagram of a rotatable clip and spring attachment mechanism in the attached configuration.

Referring to FIG. 16A, a diagram of a rotatable clip and spring attachment mechanism in the attached configuration, the attachment mechanism 1100 implements connecting portions 1100A as a rotatable clip 1602 and spring 1500. The attachment mechanism 1100 includes a rotatable clip 1602 mounted on a first portion 1610 of the attachment mechanism 1100. At least one attachment sub-mechanism 1630 is mounted on a second portion 1620 of the attachment mechanism 1100. The first portion 1610 and the second portion 1620 are on opposite sides of the sealing element 1102. In this case, attachment sub-mechanism 1630 includes spring 1500 having a spring clip 1600 configured for connecting the spring 1500 to the mask 104, optionally via additional portion 1502B. Rotatable clip 1602 is attached to the mask 104, optionally via an axle 1604 and additional portion 1502A. In the attached configuration the rotatable clip 1602 and the at least one attachment sub-mechanism 1630 are connected to the mask. As described above in reference to the at least one stopper 1584, in this case a single stopper 1504 is configured to allow sealing element 1102 to contact slit 106 with sufficient sealing pressure and to prevent contact with excessive pressure.

Figure 16B:
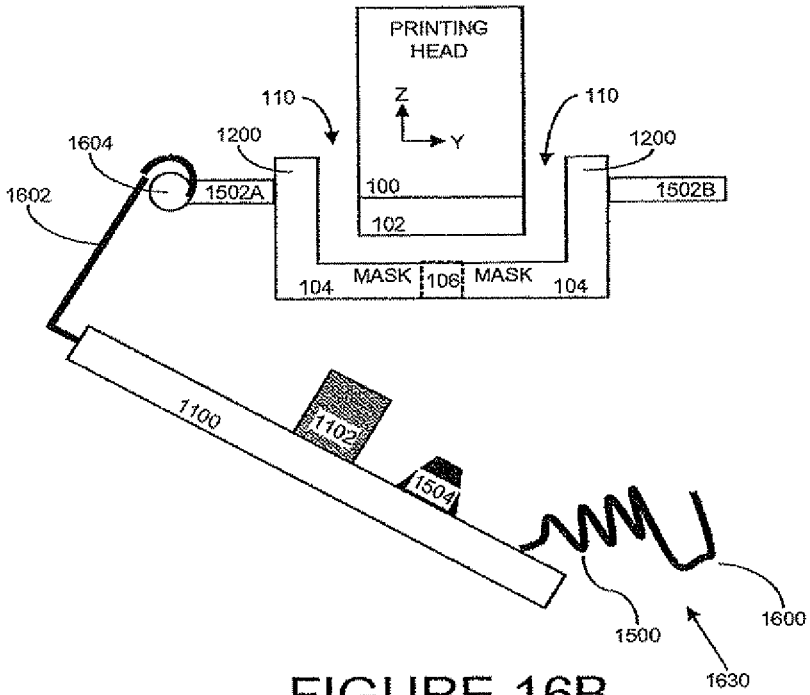
FIG. 16B is a diagram of a rotatable clip and spring attachment in the detached configuration.

FIG. 16B is a diagram of a rotatable clip and spring attachment in the detached configuration. In the detached configuration the at least one attachment sub-mechanism 1630 is disconnected from the mask 14. In the current figure, spring clip 1600 is disconnected from additional portion 1502B, thereby disconnecting spring 1500 from the mask 104. The night plate is rotated clockwise via rotatable clip 1602 on an axle 1604 to detach the sealing element 1102 from the slit 106 and move the night plate from below the printing head. In this case, the night plate is detached and remains connected to the printing head via the axle. Alternatively, the night plate can be removed from the printing head (not shown).

Figure 17A:
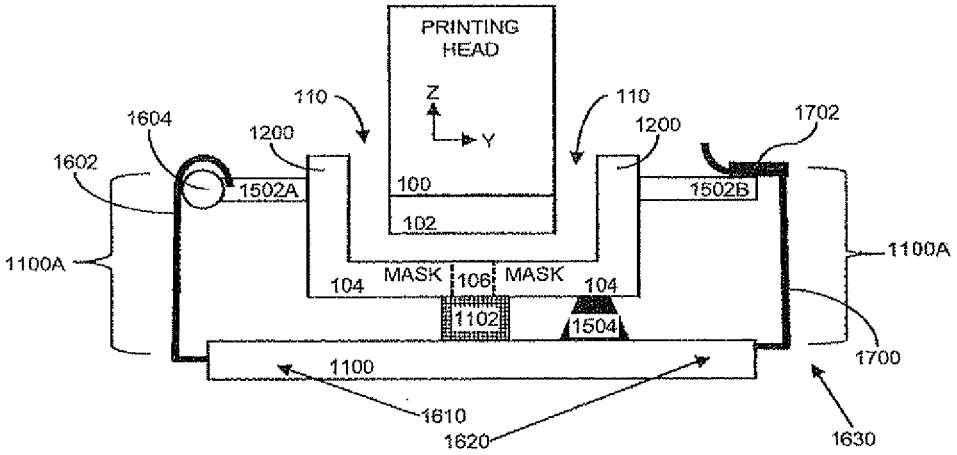
FIG. 17A is a diagram of a rotatable clip and latch attachment in the attached configuration.

FIG. 17A is a diagram of a rotatable clip and latch attachment in the attached configuration. Similar to the description in reference to FIG. 16A, the attachment mechanism 1100 implements connecting portions 1100A, as a rotatable clip 1602 and latch 1700. At least one attachment sub-mechanism 1630 is mounted on a second portion 1620 of the attachment mechanism 1100. In this case, attachment sub-mechanism 1630 includes latch 1700 having a latch clip 1702 configured for connecting the latch 1700 to the mask 104, optionally via additional portion 1502B. In the attached configuration, the rotatable clip 1602 and the at least one attachment sub-mechanism 1630 are connected to the mask.

Figure 17B:
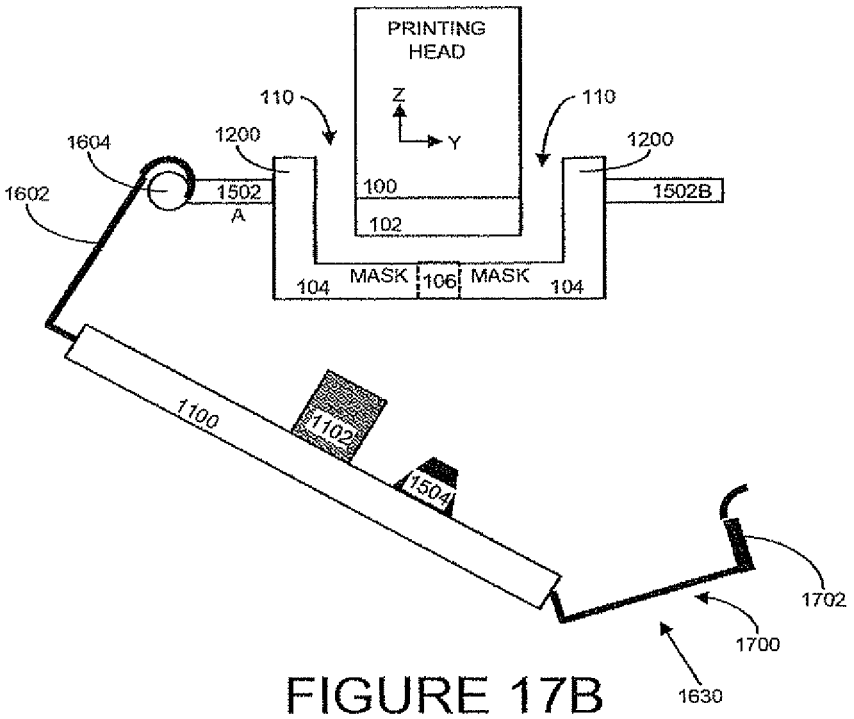
FIG. 17B is a diagram of a rotatable clip and spring attachment in the detached configuration.

FIG. 17B is a diagram of a rotatable clip and spring attachment in the detached configuration. In the detached configuration the at least one attachment sub-mechanism 1630 is disconnected from the mask 104. In the current figure, latch clip 1702 is disconnected from additional portion 152B, thereby disconnecting latch 1700 from the mask 104. The night plate is rotated clockwise via rotatable clip 1602 on an axle 1604 to detach the sealing element 1102 from the slit 106 and move the night plate from below the printing head. In this case, the night plate is detached and remains connected to the printing head via the axle. Alternatively, the night plate can be removed from the printing head (not shown).

A method for printing includes providing an attachment mechanism, the attachment mechanism configured to position a sealing element in contact with a slit of a mask. The sealing element is at least in contact with substantially all of the slit. The contact is on a bottom side of the mask. The contact has a sealing pressure sufficient for preventing a fluid on a top-side of the mask from going through the slit to the bottom-side of the mask. Positioning the sealing element in contact with the slit as currently described, corresponds to an attached configuration of a night plate.

One or more stoppers can optionally be configured as part of the night plate to prevent the sealing element from contacting the slit with excess pressure when the night plate is in the attached configuration.

Depending on the specifics of the printing system, the night plate can be attached to either the mask or to a printing head, such that the sealing element is in contact with the slit. In a detached configuration, the night plate is configured to allow jetting of ink from the inkjet printing head through the slit.

After attaching a night plate, a gap between the printing head and the top-side of the mask is filled with a sufficient amount of protecting fluid to cover at least an orifice surface of the printing head with the ink. Preferably, the protecting fluid is ink purged from the printing head. During non-printing periods, the printing head can be stored as described, with attached night plate and protecting fluid covering the orifice surface. In the currently described configuration, the presence of protecting liquid on the orifice surface, and hence on the nozzles, prevents sediment buildup on the printing head during extended periods of non-printing.

When resumption of printing is desired, the ink is removed from the gap. Optionally, other maintenance procedures can be done to the printing head and related components, with the night mask being removed to allow printing to continue.

In a typical case described above where the printing head is cradled in a mask having a slit, the nightplate is used to seal the slit, so the ink is contained in the cradle around the printing head and the ink is prevented from flowing from the cradle (via the slit). In a case where a printing head is being used without a mask, the nigh plate can include edges that surround the printing head (similar to the edges 1200 described in reference to FIG. 12 that are attached to the mask). Attaching the night plate to the head provides a cradle for the printing head. This cradle contains the purged ink from the printing head and creates a bath for the orifice surface.

Figure 20:
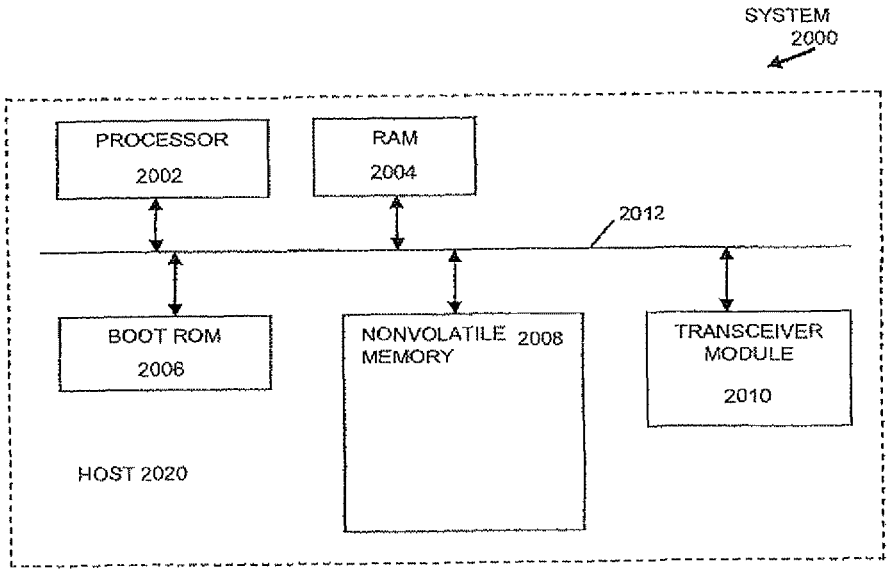
FIG. 20, a diagram of a control sub-system for a printing system.

Referring to FIG. 20, a diagram of a control sub-system for a printing system this system can be used for controlling the movement of a shaped wiper relative to a printing head and for storing a printing head in an ink retainer during periods of non-printing. Control sub-system 2000 includes a variety of processing modules, depending on the specific control required by the application. The high-level block diagram of control sub-system 2000 of the present embodiment includes a processor 2002, a transceiver module 2010, and optional memory device: a RAM 2004, a boot ROM 2006, and a nonvolatile memory 2008, all communicating via a common bus 2012. Typically, the components of control sub-system 2000 are deployed in a host 2020.

Transceiver module 2010 can be configured to receive and/or send data from various printing system components, including, but not limited to receiving information on:

- the position and status of the printing head;
- the quality of printing;
- user or automated commands for control of the printing system;
- position of one or more shaped wipers;
- quality of a protecting liquid, such as the cleanliness of a printing ink; and
- position and status of one or more ink retainers, including a night plate;

and sending information to:

- position the printing head relative to a shaped wiper or ink retainer;
- update users or other automated processes on the status of printing, quality of printing, and status of one or more shaped wipers (how long the wiper has been used, what is the cleanliness of the wiper, etc.), status and quality of a protecting liquid (such as the printing ink) used in one or more ink retainers;
- position one or more ink retainers relative to one or more printing heads;
- attach a night plate to a printing head;
- detach a night plate from a printing head;
- actuate filling an ink retainer, including a night plate, with ink; and
- actuate removing ink from an ink retainer, including from a night plate.

Information received and information to be sent can be stored in volatile memory, such as RAM 2004, and/or stored in nonvolatile memory 208. RAM 2004 and nonvolatile memory 2008 can be configured as a storage module for data. Nonvolatile memory 2008 is an example of a computer-readable storage medium bearing computer-readable code for implementing wiping using a shaped wiper and/or storage of a printing head during periods of non-printing. Other examples of such computer-readable storage media include read-only memories such as CDs bearing such code. In general, the control sub-system 2000 can be configured to implement the above-described methods of the current invention.

The use of simplified calculations to assist in the description of this embodiment should not detract from the utility and basic advantages of the invention.

It should be noted that the above-described examples, numbers used, and exemplary calculations are to assist in the description of this embodiment. Inadvertent typographical and mathematical errors should not detract from the utility and basic advantages of the invention.

It will be appreciated that the above descriptions are intended only to serve as examples, and that many other embodiments are possible within the scope of the present invention as defined in the appended claims.

What is claimed is:

1. A method of printing comprising the steps of:

(a) inserting a tip of a shaped wiper into a slit of a mask, such that one or more shoulders of a handling end of said shaped wiper are in contact with respectively one or more edges of said slit, and said tip applies a pre-determined pressure to an orifice surface; and (b) moving said shaped wiper relative to said orifice surface such that said tip wipes said orifice surface, wherein (i) said tip has a tip-width and a tip-height;

(ii) said handling end has a side with a side-width greater than said tip-width:

(iii) said tip is positioned on said side so as to configure said handling end with said one or more shoulders on said side, a shoulder-width of said one or more shoulders being the difference between said side-width and said tip-width;

(iv) said tip-height configured such that when said one or more shoulders are pressed against said one or more edges of said slit with a given shield-depth, said tip-height is substantially equal to said shield depth;

(v) said mask is associated with an orifice surface;

(vi) said shield-depth is a distance between said one or more edges of said slit and said orifice surface.

2. The method of claim 1 wherein the step of inserting a tip includes a method selected from the group consisting of:

(i) inserting via a wider section on a side of said slit, said wider section configured to accept said tip of said shaped wiper and guide said tip into said slit;

(ii) inserting via a side of said slit; and (iii) inserting from a bottom of the slit.

3. The method of claim 1 wherein said pre-determined pressure results from said one or more shoulders pressed against one or more edges of said slit.

4. The method of claim 1 wherein the step of moving said shaped wiper includes moving said shaped wiper along said slit while maintaining contact between said one or more shoulders and respectively said one or more edges of said slit.

5. The method of claim 1 wherein during non-wiping periods, at least said tip of said shaped wiper is stored in a fluid selected from the group consisting of: cleaning liquid, and printing liquid.

6. The method of claim 1 wherein said slit has a slit-width substantially equal to a tip-width of said tip.

7. The method of claim 1 wherein said orifice surface has one or more orifices having an orifice-diameter, and a tip-width of said tip is at least as wide as said orifice-diameter, thereby allowing said one or more orifices to be wiped by one pass of said tip of said shaped wiper.

8. The method of claim 1 wherein said pre-determined pressure is selected from an acceptable pre-determined range of pressures.

9. A printing system comprising:

(a) a shaped wiper including:

(i) a tip having a tip-width and a tip-height; and (ii) a handling end having a side with a side-width greater than said tip-width;

wherein said tip is positioned on said side so as to configure said handling end with one or more shoulders on said side, the shoulder-width of said one or more shoulders being the difference between said side-width and said tip-width; and said tip-height configured such that when said one or more shoulders are pressed against one or more edges of a slit with a given shield-depth, said tip-height is substantially equal to said shield depth, wherein said slit is of a mask, said mask is associated with an orifice surface, and said shield-depth is a distance between said one or more edges of said slit and said orifice surface.

10. The printing system of claim 9 wherein said tip is positioned on said side so as to configure said handling end with two shoulders, each of said two shoulders on opposite sides of said tip.

11. The printing system of claim 9 wherein when said one or more shoulders are pressed against one or more edges of a slit with a given shield-depth, said tip applies a pre-determined pressure to said orifice surface.

12. The printing system of claim 11 wherein said pre-determined pressure is selected from an acceptable pre-determined range of pressures.

13. The printing system of claim 9 wherein comprising a printing mask including said slit, said slit having a slit-width substantially equal to said tip-width.

14. The printing system of claim 13 wherein said slit includes one or more wider sections on at least one corresponding side of said slit, said wider sections configured to accept said tip of said shaped wiper and guide said tip into said slit.

15. The printing system of claim 13 wherein said slit-width is between 0.4 millimeter (mm) and 2 mm.

16. The printing system of claim 15 wherein said tip-width is substantially equal to said slit-width.

17. The printing system of claim 13 wherein said shield-depth from said orifice surface to a bottom of said mask is between 0.4 mm and 2 mm (shield-depth=0.4 to 2 mm) and said tip-height from said one or more shoulders to a distal end of said tip is said shield-depth plus 5% to 30% of said shield-depth (tip-height=shield-depth+5% to 30%).

18. The printing system of claim 9 wherein said tip is made of a material selected from the group consisting of:

(i) an open-cell foam; and (ii) polyolefin.

19. The printing system of claim 9 wherein said orifice surface is of an inkjet printing head.

* * * * *